US008684353B2

(12) United States Patent
Miyazawa

(10) Patent No.: US 8,684,353 B2
(45) Date of Patent: Apr. 1, 2014

(54) SHEET CONVEYING APPARATUS AND IMAGE FORMING APPARATUS

(75) Inventor: Hideaki Miyazawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 163 days.

(21) Appl. No.: 13/268,181

(22) Filed: Oct. 7, 2011

(65) Prior Publication Data

US 2012/0091653 A1 Apr. 19, 2012

(30) Foreign Application Priority Data

Oct. 15, 2010 (JP) ..... 2010-232690

(51) Int. Cl.
*B65H 9/16* (2006.01)

(52) U.S. Cl.
USPC ..... 271/250; 271/273

(58) Field of Classification Search
USPC ..... 271/228, 248, 250, 251, 252, 273, 274
See application file for complete search history.

(56) References Cited

U.S. PATENT DOCUMENTS

| | | | | |
|---|---|---|---|---|
| 5,253,862 | A | 10/1993 | Acquaviva et al. | |
| 6,273,418 | B1 | 8/2001 | Fujikura et al. | |
| 6,789,794 | B2 | 9/2004 | Miyazawa | |
| 7,306,221 | B2 | 12/2007 | Agata | |
| 8,002,272 | B2 | 8/2011 | Miyazawa | |
| 8,025,288 | B2 | 9/2011 | Shoji et al. | |
| 2005/0242493 | A1 | 11/2005 | Agata | |
| 2008/0240821 | A1* | 10/2008 | Shoji et al. | 399/395 |
| 2009/0267292 | A1* | 10/2009 | Inui et al. | 271/229 |
| 2010/0327519 | A1 | 12/2010 | Miyazawa | |
| 2011/0260395 | A1 | 10/2011 | Miyazawa | |

FOREIGN PATENT DOCUMENTS

| | | | |
|---|---|---|---|
| CN | 101462651 | A | 6/2009 |
| CN | 101462651 | B | 1/2013 |
| JP | 11-189355 | A | 7/1999 |
| JP | 2003-063696 | A | 3/2003 |
| JP | 2004-059188 | A | 2/2004 |
| JP | 3769913 | B2 | 4/2006 |
| JP | 3890937 | B2 | 3/2007 |
| JP | 2009-046220 | A | 3/2009 |

OTHER PUBLICATIONS

European Search Report in EP Application No. 11184807.3, mail date Jan. 16, 2013.
Office Action in Chinese Application No. 201110310638.1 dated Jan. 6, 2014.

* cited by examiner

*Primary Examiner* — Michael McCullough
*Assistant Examiner* — Howard Sanders
(74) *Attorney, Agent, or Firm* — Fitzpatrick, Cella, Harper & Scinto

(57) ABSTRACT

A skew feeding correction portion includes a first pair of skew-feed rollers that has rollers, a second pair of skew-feed rollers, a third pair of skew-feed rollers, as skewing at the downstream side of the second pair of skew-feed rollers, and a reference member that is arranged along a sheet conveying direction and that corrects the skew feeding of the sheet in such a manner that a side end of the sheet, which is conveyed as being skewed by the respective pairs of skew-feed rollers, is brought into contact with the reference member, wherein the first pair of skew-feed rollers releases the nip of the sheet by separating the rollers from each other before the sheet is nipped by the third pair of skew-feed rollers after the sheet is nipped by the second pair of skew-feed rollers.

8 Claims, 20 Drawing Sheets

SLIP IS GENERATED AT NIP N2 OF SKEW-FEED ROLLERS

↓

DEFLECTION IS ELIMINATED

RELATIONSHIP AMONG SKEW FEEDING NIP PRESSURES $P1 \leq P2 \leq P3$

SHEET CONVEYING APPARATUS AND IMAGE FORMING APPARATUS

BACKGROUND OF THE INVENTION

1. Field of the Invention

The present invention relates to a sheet conveying apparatus and an image forming apparatus, and more particularly to a sheet conveying apparatus that corrects a skew feeding of a sheet and a position of a sheet in a width direction, and an image forming apparatus provided with the sheet conveying apparatus.

2. Description of the Related Art

In an image forming apparatus such as a copying machine, printer, or facsimile machine, when a sheet that is to be conveyed is skewed, or a deviation is caused at the position (hereinafter referred to as a "lateral registration position") in the width direction orthogonal to a sheet conveying direction, an image is unfavorably formed on a sheet with an image position deviated. In view of this, the sheet conveying apparatus of the image forming apparatus is provided with a skew feeding correction portion that aligns a posture or position of a sheet before a sheet is conveyed to an image forming portion.

The skew feeding correction portion is generally provided at the upstream side of a transfer portion for transferring an image onto a sheet. For example, the skew feeding correction portion performs a skew feeding correction of a sheet on a side registration basis in which a positional deviation of a sheet is corrected based on a side end of the sheet that is currently conveyed (see U.S. Pat. No. 6,273,418).

The skew feeding correction portion that corrects the skew feeding of the sheet on the side registration basis includes an abutment reference member provided along a sheet conveying direction at one side of a sheet conveying path, and plural pairs of skew-feed rollers (skewed rollers) arranged on the sheet conveying path. The abutment reference member has a reference surface that is substantially parallel to the sheet conveying direction. The plural pairs of skew-feed rollers are arranged along the reference surface in the sheet conveying direction. The skew of the sheet with respect to the sheet conveying direction is corrected in such a manner that the sheet, which is currently conveyed, is conveyed as being skewed toward the reference member by the pair of skew-feed rollers, and the side end of the sheet abuts on the reference surface so as to allow the sheet to be along the reference surface. The position of the side end of the sheet in a direction orthogonal to the sheet conveying direction can be specified by the reference surface, whereby the positional deviation of the sheet in the width direction can be corrected based on the position of the reference surface.

However, as illustrated in FIG. 18A, when the sheet S is nipped by a first pair of skew-feed rollers 32*a* located at the most upstream side, force Fp that is exerted in a direction reverse to the sheet conveying direction is applied to a center of gravity of the sheet S. When the distance from the center of gravity to the side end of the sheet is defined as Lp, a moment M (=Fp×Lp) that the sheet tries to turn in a direction of an arrow in FIG. 18A is caused on the side end of the sheet S. The sheet turns due to the moment M, and the side end of the sheet S abuts on the abutment reference member 31, whereby the skew feeding is corrected. Simultaneously, a deflection is generated on the side end of the sheet S.

In the conventional skew feeding correction portion, when a force of pressing the sheet toward the reference surface (force of moving the sheet toward the reference surface by the pair of skew-feed rollers) is too strong when the side end of the sheet abuts on the reference surface of the abutment reference member, the sheet is deflected, which might entail a jamming of the sheet or deterioration in correction precision.

There has been proposed a sheet conveying apparatus that changes a nip pressure of the skew-feed rollers to adjust the force of pressing the side end of the sheet toward the reference surface, in order to allow the side end of the sheet to be along the reference surface without the generation of the deflection, whereby the skew feeding is corrected (see U.S. Pat. No. 5,253,862).

In the sheet conveying apparatus described in U.S. Pat. No. 5,253,862, the nip pressure of the pair of skew-feed rollers is adjusted according to a correction method on a side registration basis, whereby the force of pressing the sheet toward the abutment reference member can be adjusted. However, the skew feeding correction is sometimes not sufficient. For example, problems described below might arise for a sheet having low stiffness property (hereinafter referred to as "stiffness") such as a super thin sheet (a coated paper having a basis weight of less than 80 gsm), or for a case under high-temperature high-humidity environment in which a stiffness of a sheet is reduced owing to humidity.

Plural pairs of skew-feed rollers are arranged in the sheet conveying direction. When the pair of skew-feed rollers at the upstream side, which conveys a sheet as skewing at the beginning, nips the sheet, the sheet turns and abuts on the reference surface of the abutment reference member, whereby a deflection is generated on the side end of the sheet. In a sheet having high stiffness, the deflection is eliminated by the stiffness of the sheet. However, in a sheet having low stiffness, the deflection is not eliminated, and with this state, the sheet is nipped by the next pair of skew-feed rollers. Therefore, the skew feeding correction is not sufficiently performed owing to the difference in the magnitude of the deflection (deflection difference) caused in the sheet conveying direction. In particular, when the sheet S is conveyed as being nipped by plural pairs of skew-feed rollers as illustrated in FIG. 18B, the deflection is difficult to be eliminated. When the sheet is conveyed to the third pair of skew-feed rollers, the deflection might be buckled (folded) to cause a paper jam.

In view of this, the present invention aims to provide a sheet conveying apparatus provided with a skew feeding correction portion that can stably correct a skew feeding of a sheet, regardless of a type of sheet, and an image forming apparatus provided with the sheet conveying apparatus.

SUMMARY OF THE INVENTION

A first aspect of the present invention is a sheet conveying apparatus comprising a skew feeding correction portion arranged to correct a skew feeding of a sheet conveyed along a sheet conveying path in a sheet conveying direction, the skew feeding correction portion including:

a reference member extending in the sheet conveying direction;

a first pair of skew-feed rollers;

second pair of skew-feed rollers positioned downstream of the first pair of skew-feed rollers in the sheet conveying direction;

a third pair of skew-feed rollers positioned downstream of the second pair of skew-feed rollers in the sheet conveying direction;

wherein the first, second and third pairs of skew-feed rollers are each arranged to nip the sheet and to convey the sheet towards the reference member such that the sheet abuts the reference member to correct a skew of the sheet;

a moving mechanism arranged to move the first pair of skew-feed rollers between a nip position in which the first pair of skew-feed rollers are in contact with each other and a separate position in which the first pair of skew-feed rollers are separated from each other;

a controlling portion arranged to control the moving mechanism so as to move the first pair of skew-feed rollers from the nip position to the separate position after the sheet, conveyed by the first pair of skew-feed rollers, is nipped by the second pair of skew-feed rollers and before the sheet is nipped by the third pair of skew-feed rollers.

According to the present invention, the sheet that is conveyed as being skewed by the first pair of skew-feed rollers is nipped by the second pair of skew-feed rollers, and the first pair of skew-feed rollers is separated from each other so as to release the nip of the sheet, before the sheet reaches the third pair of skew-feed rollers. Thus, the skew feeding correction of the sheet can stably be executed, regardless of a type of sheet and a usage environment.

Further features of the present invention will become apparent from the following description of exemplary embodiments with reference to the attached drawings.

DESCRIPTION OF THE EMBODIMENTS

An image forming apparatus provided with a sheet conveying apparatus according to an embodiment of the present invention will be described below with reference to the drawings. The image forming apparatus according to the present embodiment is an image forming apparatus provided with a sheet conveying apparatus, which has a sheet aligning portion for correcting a skew feeding of a sheet to be conveyed and a position of a sheet in a width direction, such as a copying machine, a printer, a facsimile machine, and a multifunction peripheral.

From the viewpoint of a configuration, the image forming apparatus is classified into a tandem type in which plural image forming portions are arranged side by side, and a rotary type in which plural image forming portions are cylindrically arranged. From the viewpoint of a transfer system, the image forming apparatus is classified into a direct transfer system for transferring a toner image directly onto a sheet from a photosensitive drum, and an intermediate transfer system for temporarily transferring the toner image onto an intermediate transfer member, and then, transferring the toner image onto the sheet.

In the intermediate transfer system, the sheet does not have to be retained onto the transfer belt as in the direct transfer system, so that this system can be applied to a wide variety of sheets such as a super thick paper or a coated paper. This system is also suitable for realizing high-productivity, since it has a feature of a simultaneous process in plural image forming portions and a collective transfer of a full-color image. Therefore, in the embodiment below, an image forming apparatus 100 of an intermediate transfer system is used, wherein image forming units of four colors are arranged on an intermediate transfer belt.

Figure 1:
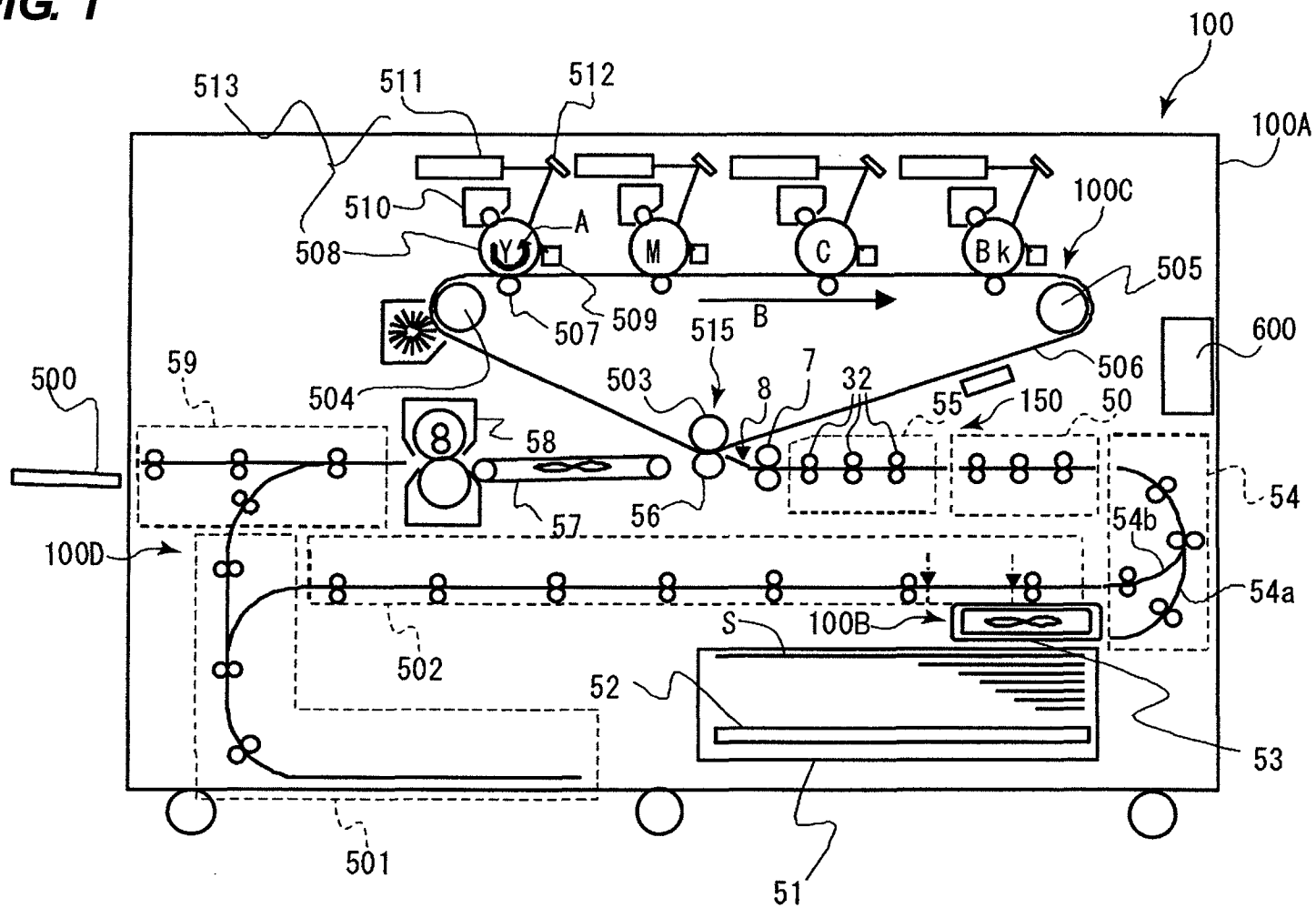
FIG. 1 is a sectional view schematically illustrating an overall structure of an image forming apparatus according to an embodiment of the present invention.

An overall structure of the image forming apparatus 100 according to the present embodiment will be described with reference to FIG. 1. FIG. 1 is a sectional view schematically illustrating an overall structure of the image forming apparatus 100 according to the embodiment of the present invention.

As illustrated in FIG. 1, the image forming apparatus 100 includes an image forming apparatus body (hereinafter referred to as "apparatus body") 100A that forms an outer appearance of the image forming apparatus 100. The apparatus body 100A is provided with an image forming portion 513, a sheet feeding portion 100B for feeding a sheet S, a transfer portion 100C for transferring a toner image, formed at the image forming portion 513, onto the sheet S, and a sheet conveying portion 100D serving as a sheet conveying apparatus for conveying the sheet S.

The image forming portion 513 includes image forming units of yellow (Y), magenta (M), cyan (C), and black (Bk), each unit having a photosensitive drum 508, an exposure portion 511, a development portion 510, a primary transfer portion 507, and a cleaner portion 509. The colors of the image forming units are not limited to four colors described above, and the order of the image forming units is not limited to the one described above.

The sheet feeding portion 100B includes a sheet accommodating portion 51 for accommodating the sheet S as stacking the sheet S onto a lift-up portion 52, and a sheet feeding unit 53 for feeding the sheet S accommodated in the sheet accommodating portion 51. The sheet feeding unit 53 may employ a system utilizing a frictional separation with the use of a sheet feeding roller, or a system utilizing separation and adsorption by air. In the present embodiment, a sheet feeding system using air is employed.

The transfer portion 100C includes an intermediate transfer belt 506 that is stretched by rollers including a driving roller 504, a tension roller 505, a secondary transfer inner roller 503, and a secondary transfer roller 56, and that is driven in a direction of B in FIG. 1. The toner image formed onto the photosensitive drum is transferred onto the intermediate transfer belt 506 owing to a predetermined pressure force and an electrostatic load bias applied at the primary transfer portion 507. The toner image transferred onto the intermediate transfer belt 506 is attracted onto the sheet S, as a non-fused image, owing to a predetermined pressure force and an electrostatic load bias applied at a secondary transfer portion 515 provided with the secondary transfer inner roller 503 and the secondary transfer roller 56, these rollers being arranged so as to be opposite to each other.

The sheet conveying portion 100D includes a conveying unit 54 for conveying the sheet S, a sheet aligning portion 150, a pair of registration rollers 7, a pre-fixing conveying portion 57 for conveying the sheet S to the fixing portion 58, a branched conveying path 59, an inverse conveying path 501, and a duplex conveying path 502. The conveying unit 54, the pre-fixing conveying portion 57, the branched conveying path 59, the inverse conveying path 501, and the duplex conveying path 502 form a sheet conveying path.

Many pairs of conveying rollers are arranged on the conveying unit 54, the branched conveying path 59, the inverse conveying path 501, and the duplex conveying path 502. Each of the pairs of conveying rollers is configured to include a driving roller and a driven roller, wherein the driving roller and the driven roller are rotated as nipping the sheet S therebetween so as to convey the sheet S. The driven roller is applied with a force to the driving roller by an unillustrated biasing member such as a spring, whereby the pairs of conveying rollers set a nip pressure for nipping the sheet S between both rollers.

The sheet aligning portion 150 includes a conveying roller portion 50 and a skew feeding correction portion 55, in order to correct the skew feeding of the sheet S and the position of the sheet S in the width direction. The pair of registration rollers 7 includes a driving roller and a driven roller that is in pressed contact with the driving roller so as to be capable of being separated from the driving roller for conveying the sheet with the driving roller. The pair of registration rollers 7 conveys the sheet S to the secondary transfer portion 515 at a predetermined timing.

FIG. 1 also illustrates a controlling portion 600, serving as a controller, for controlling an image forming operation of the image forming apparatus 100 and a later-described operation of correcting a skew feeding of the sheet.

The image forming operation of the image forming apparatus 100 according to the present embodiment will next be described. The sheet S is fed one by one by the sheet feeding unit 53 at a predetermined image forming timing, and passes through a conveying path 54*a* of the conveying unit 54 to be conveyed to the sheet aligning portion 150. A skew feeding correction and a timing correction are executed at the sheet aligning portion 150, and then, the sheet S is fed to the secondary transfer portion 515 at a predetermined timing by the pair of registration rollers 7.

During this process, in the image forming portion 513, the photosensitive drum 508 is rotated in a direction of A in FIG. 1, and the unillustrated charging portion uniformly charges the photosensitive drum 508. Thereafter, the exposure portion 511 emits light to the rotating photosensitive drum 508 based on a signal of transmitted image information. This light is irradiated via a reflection portion 512, whereby an electrostatic latent image is formed on the photosensitive drum 508. The toner slightly remaining on the photosensitive drum 508 is collected by the cleaner portion 509 for preparing for a next image formation.

After the electrostatic latent image is formed on the photosensitive drum 508, a toner development is performed to the electrostatic latent image by the development portion 510, whereby a toner image is formed on the photosensitive drum 508. A predetermined pressure and electrostatic load bias are applied to the toner image formed on the photosensitive drum 508 by the primary transfer portion 507, whereby the toner image is transferred onto the intermediate transfer belt 506. The image formation by each of the image forming units of yellow, magenta, cyan, and black in the image forming portion 513 is executed at such a timing that toner images at the downstream side are overlaid on the toner image at the upstream side primarily transferred onto the intermediate transfer belt 506. Thus, a full-color toner image is finally formed on the intermediate transfer belt 506.

The full-color toner image formed on the intermediate transfer belt 506 is transferred onto the sheet S fed to the secondary transfer portion 515 by the pair of registration rollers 7 at a predetermined timing. The sheet S on which the full-color image is transferred is conveyed to the fixing portion 58 by the pre-fixing conveying portion 57. A heat from a heat source such as a heater and a predetermined pressure are applied at the fixing portion 58, whereby the toner image is fused to be fixed onto the sheet S.

The sheet S having the image fixed thereon is discharged onto a discharge tray 500 through the branched conveying path 59. When an image is formed on both surfaces of the sheet S, the sheet S is conveyed to the inverse conveying path 501 by an unillustrated switching member. When the sheet S is conveyed to the inverse conveying path 501 as described above, the leading end and the trailing end are switched owing to a switchback operation, and the sheet S is conveyed to the duplex conveying path 502 with this state.

Thereafter, the sheet S joins from a re-feeding path 54*b* of the conveying unit 54 at a timing of the sheet S fed from the sheet feeding portion 100B in a subsequent job, and is conveyed to the secondary transfer portion 515 as in the same manner as described above. The image forming process is the same as that for the first surface (for one side) described above, so that the description will not be repeated again. The sheet S having the image formed and fixed on the second surface (other surface) is discharged onto the discharge tray 500 via the branched conveying path 59.

Next, the sheet aligning portion 150 provided to the sheet conveying portion 100D of the image forming apparatus 100 according to the present embodiment will specifically be described with reference to FIGS. 2A to 9. The sheet aligning portion 150 is arranged at the upstream side of the secondary transfer portion 515, and includes the conveying roller portion 50, and the skew feeding correction portion 55 arranged at the downstream side of the conveying roller portion 50.

Figure 2A:
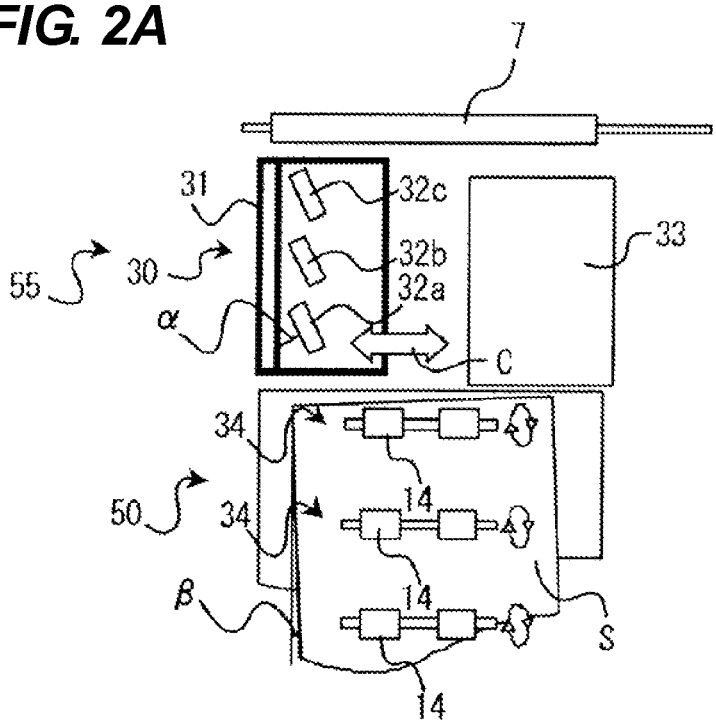
FIG. 2A is a plan view illustrating a state in which a sheet is conveyed through a conveying roller portion as being skewed.
Figure 2B:
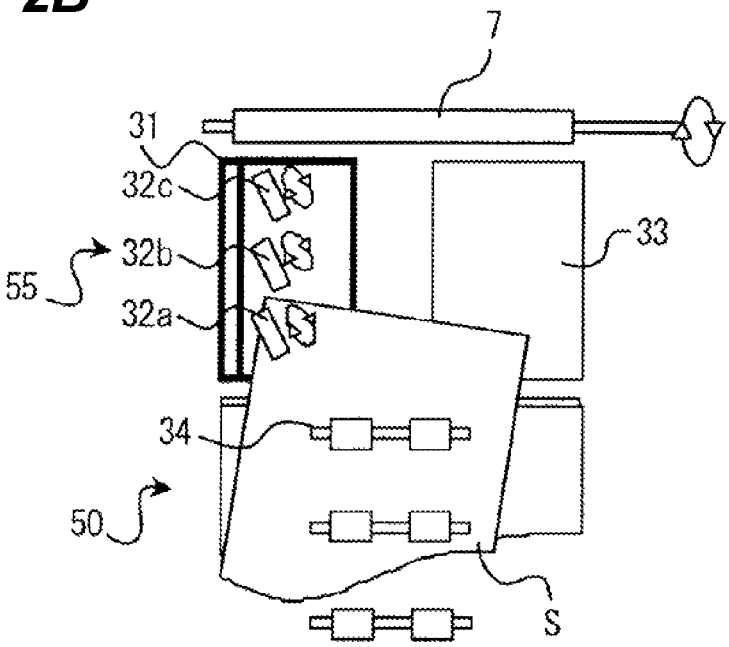
FIG. 2B is a plan view illustrating a state in which the sheet is turned at a skew feeding correction portion.
Figure 2C:
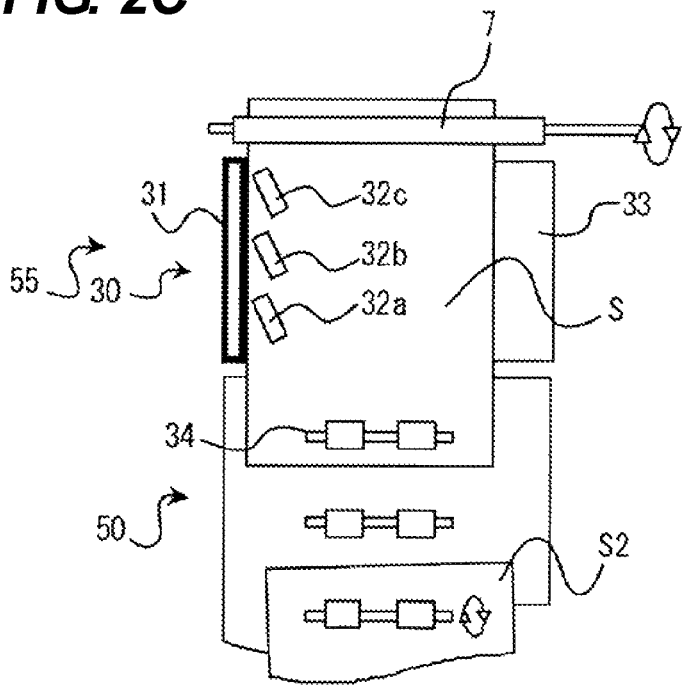
FIG. 2C is a plan view illustrating a state in which the sheet, whose skew is corrected, is conveyed by a pair of registration rollers.
Figure 2D:
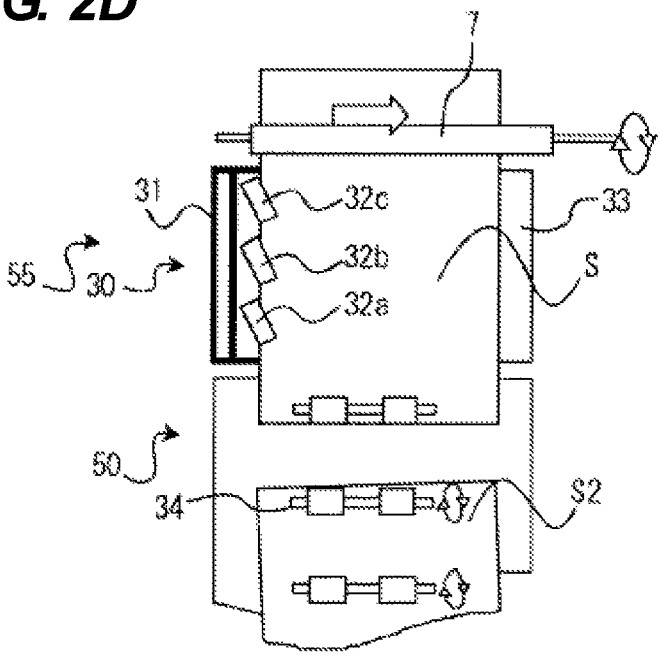
FIG. 2D is a plan view illustrating a state in which a subsequent sheet is conveyed through the conveying roller portion as being skewed.
Figure 3A:
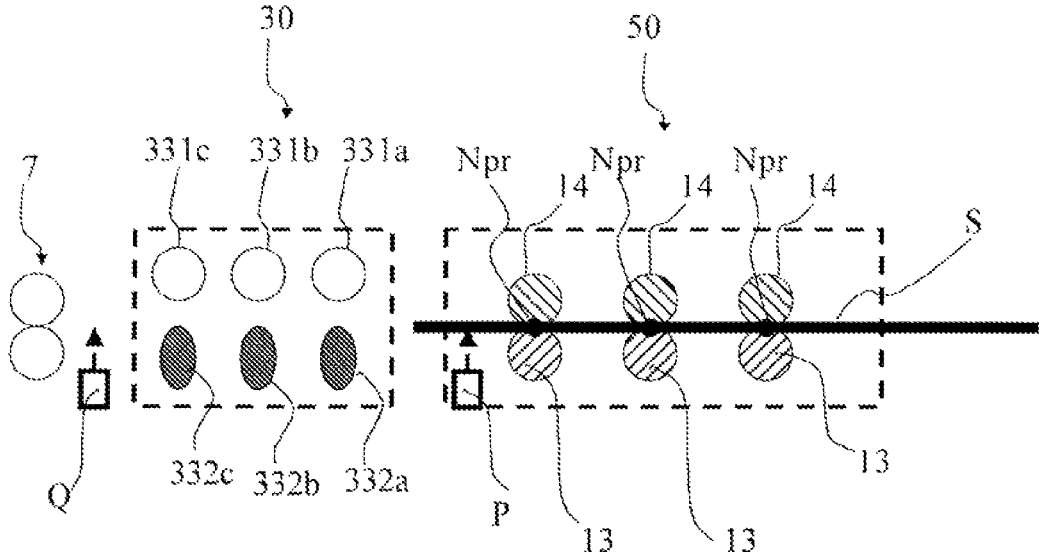
FIG. 3A is a sectional view schematically illustrating a state in which a pair of conveying rollers nips the sheet.
Figure 3B:
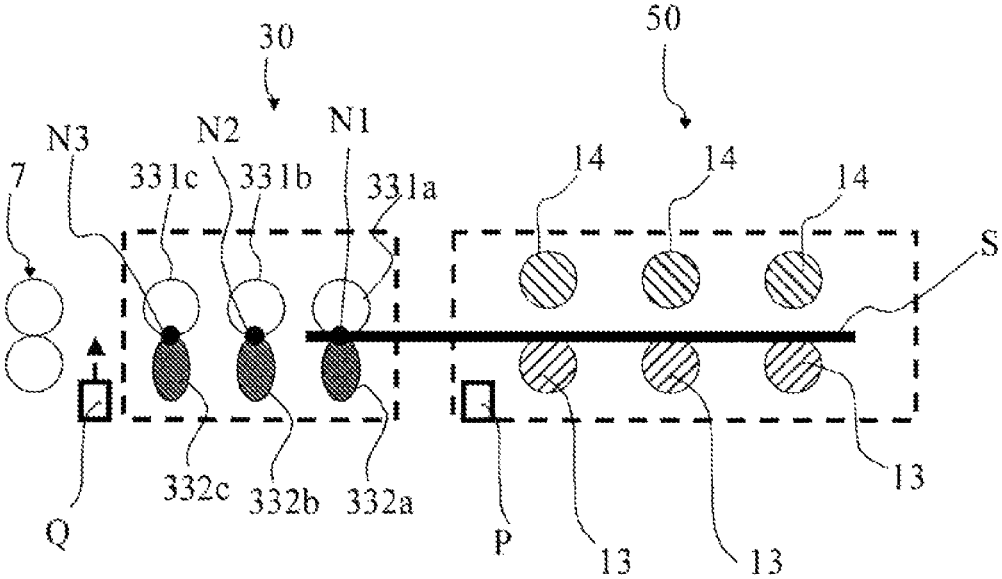
FIG. 3B is a sectional view schematically illustrating a state in which the pair of conveying rollers releases the nip of the sheet.
Figure 4:
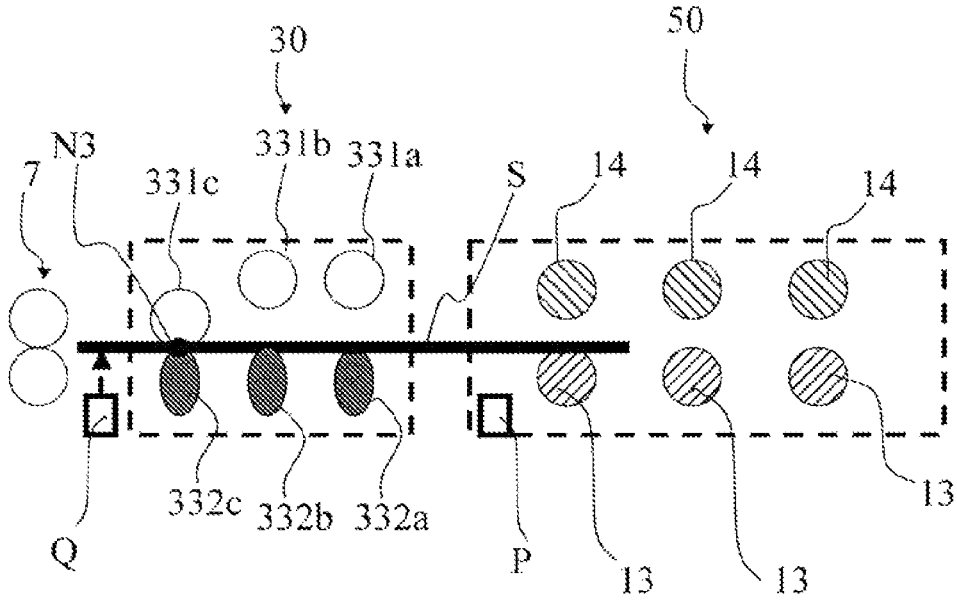
FIG. 4 is a sectional view illustrating a state in which a pair of third skew-feed rollers nips the sheet.

The conveying roller portion 50 will firstly be described with reference to FIGS. 2A to 4. FIG. 2A is a plan view illustrating a state in which the sheet S is conveyed through the conveying roller portion 50 as being skewed. FIG. 2B is a plan view illustrating a state in which the sheet S is turned at the skew feeding correction portion 55. FIG. 2C is a plan view illustrating a state in which the sheet S, whose skew is corrected, is conveyed by the pair of registration rollers 7. FIG. 2D is a plan view illustrating a state in which a subsequent sheet S2 is conveyed through the conveying roller portion 50 as being skewed. FIG. 3A is a sectional view schematically illustrating a state in which a pair of conveying rollers 34 nips the sheet S. FIG. 3B is a sectional view schematically illustrating a state in which the pair of conveying rollers 34 releases the nip of the sheet S. FIG. 4 is a sectional view illustrating a state in which a pair of third skew-feed rollers 32*c* nips the sheet S.

As illustrated in FIGS. 2A to 4, the conveying roller portion 50 is configured to include plural pairs of conveying rollers 34, each pair including a driving roller 13 and a driven roller 14. The driven roller 14 is configured to be capable of being pressed against and separated from the driving roller 13. The pair of conveying rollers 34 is configured such that the driven roller 14 is pressed against or separated from the driving roller 13, by which the state of nipping the sheet S by the driving roller 13 and the driven roller 14 and the state of releasing the nip of the sheet S can be changed.

The driving roller 13 is made of a rubber material such as a natural rubber or synthetic rubber, while the driven roller 14 is made of a synthetic resin material. In the following description, the state in which the driving roller 13 and the driven roller 14 nip the sheet S is also referred to as a "nip state", and the state in which the nip of the sheet S is released is also referred to as a "nip release state".

Figure 5A:
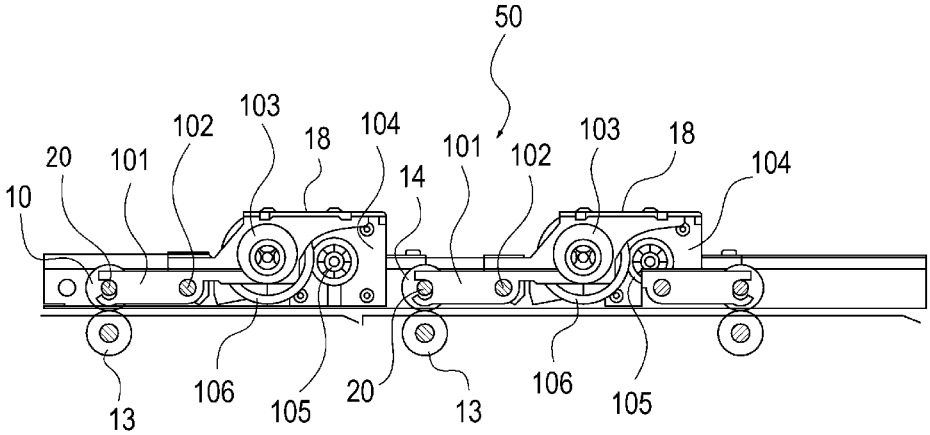
FIG. 5A is a sectional view illustrating the nip state of the pair of conveying rollers according to the embodiment of the present invention.
Figure 5B:
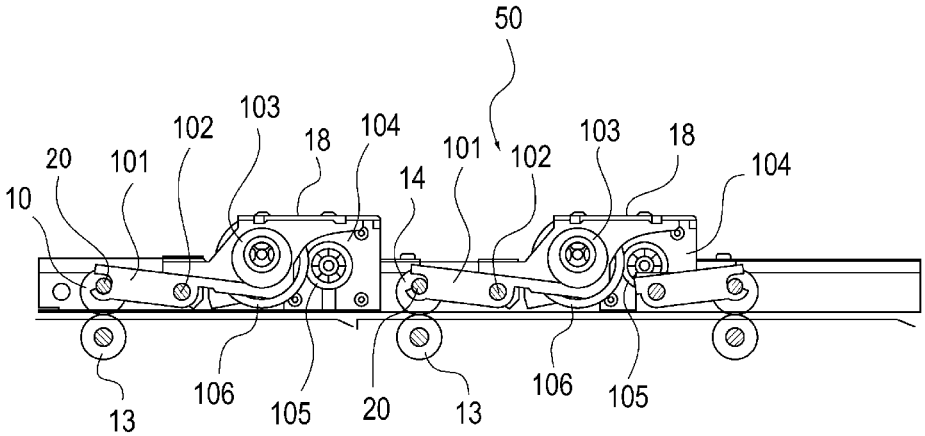
FIG. 5B is a sectional view illustrating the nip release state of the pair of conveying rollers.

Next, a nip release mechanism of the pair of conveying rollers 34 for changeover from the nip state to the nip release state will be described with reference to FIGS. 5A and 5B. FIG. 5A is a sectional view illustrating the nip state of the pair of conveying rollers 34 according to the present embodiment. FIG. 5B is a sectional view illustrating the nip release state of the pair of conveying rollers 34.

As illustrated in FIG. 5A, the driven roller 14 is supported by an arm member 101 through a driven shaft 20 so as to be capable of rotating, wherein the arm member 101 is supported by a stay member 18 through a swing shaft 102 so as to be capable of swinging. The arm member 101 is brought into contact with the driving roller 13 by an eccentric roller 103, and the eccentric roller 103 is connected to a pre-registration pressure release motor (stepping motor) 104 through gear trains 105 and 106.

When the pair of conveying rollers 34 is separated from each other, the pre-registration pressure release motor 104 is rotated to rotate the eccentric roller 103 through the gear trains 105 and 106, whereby the end portion of the arm member 101 is pressed by the eccentric roller 103. Thus, the arm member 101 located at the position illustrated in FIG. 5A swings in the nip releasing direction about the swing shaft 102. Specifically, as illustrated in FIG. 5B, the driven roller 14 lifts up, so that the nip between the driving roller 13 and the driven roller 14 is released, which means that the pair of conveying rollers 34 is in the separated state. In the present embodiment, the pre-registration pressure release motor 104 is rotated at a detection timing of a pre-registration sensor P, whereby the timing of the nip release can be changed.

Figure 6:
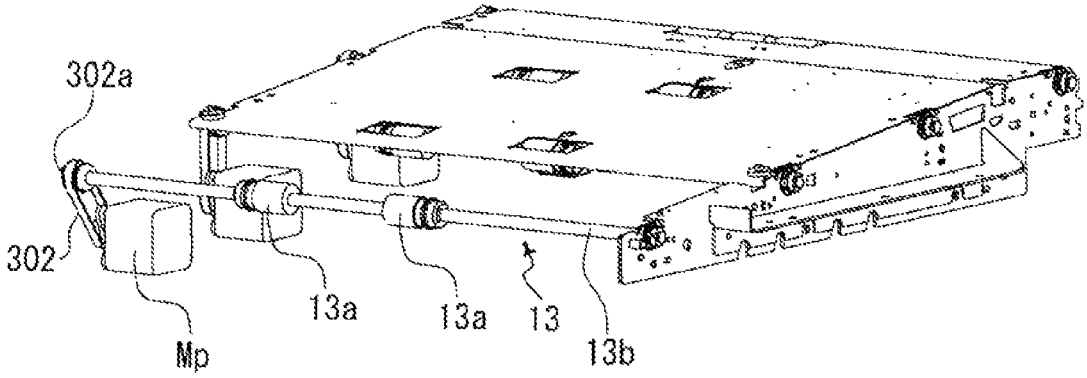
FIG. 6 is a perspective view illustrating a drive portion of the conveying roller portion according to the embodiment of the present invention.

A drive portion of the conveying roller portion 50 will be described next with reference to FIG. 6. FIG. 6 is a perspective view illustrating the drive portion of the conveying roller portion 50 according to the present embodiment. As illustrated in FIG. 6, a rotational driving force from a pre-registration motor Mp is transmitted to a roller shaft 13*b*, to which a drive rubber roller 13*a* is fixed, of the driving roller 13 through a pulley 302*a* and a belt 302. The pre-registration motor Mp serving as a drive portion for driving the driving roller 13 is a stepping motor, wherein a stop timing and the rotation speed can be changed according to the timing of the pre-registration sensor P by the pre-registration motor Mp.

The driven roller 14 is located at the position, illustrated in FIG. 3A, where the driven roller 14 presses the driving roller 13, when the driven roller 14 conveys the sheet S conveyed from the conveying unit 54. Therefore, after being conveyed from the conveying unit 54, the sheet S is nipped by the plural pairs of conveying rollers 34 to be conveyed to later-described first to third pairs of skew-feed rollers 32*a* to 32*c* of the skew feeding correction portion 55. On the other hand, before the sheet S reaches the second pair of skew-feed rollers 32*b* at the downstream side after it reaches the first pair of skew-feed rollers 32*a* of the skew feeding correction portion 55 at the most upstream side in the sheet conveying direction, the driven rollers 14 are separated from the corresponding driving rollers 13 as illustrated in FIG. 3B. Since each of the driven rollers 14 is separated to release the nip between the driven roller 14 and the driving roller 13, the hindrance of the skew feeding of the sheet S by the pairs of conveying rollers 34 can be prevented, when the sheet S is fed as being skewed by the first to third pairs of skew-feed rollers 32*a* to 32*c*.

An optical pre-registration sensor P illustrated in FIGS. 3A and 3B has a light-emitting portion (not illustrated) and a light-receiving portion (not illustrated). The pre-registration sensor P is configured to detect light, reflected by the sheet S, at the light-receiving portion so as to detect a passage timing of the sheet S, when the sheet S passes through the pre-registration sensor P.

The skew feeding correction portion 55 will next be described with reference to FIGS. 7 to 9B in addition to FIGS.

Figure 7:
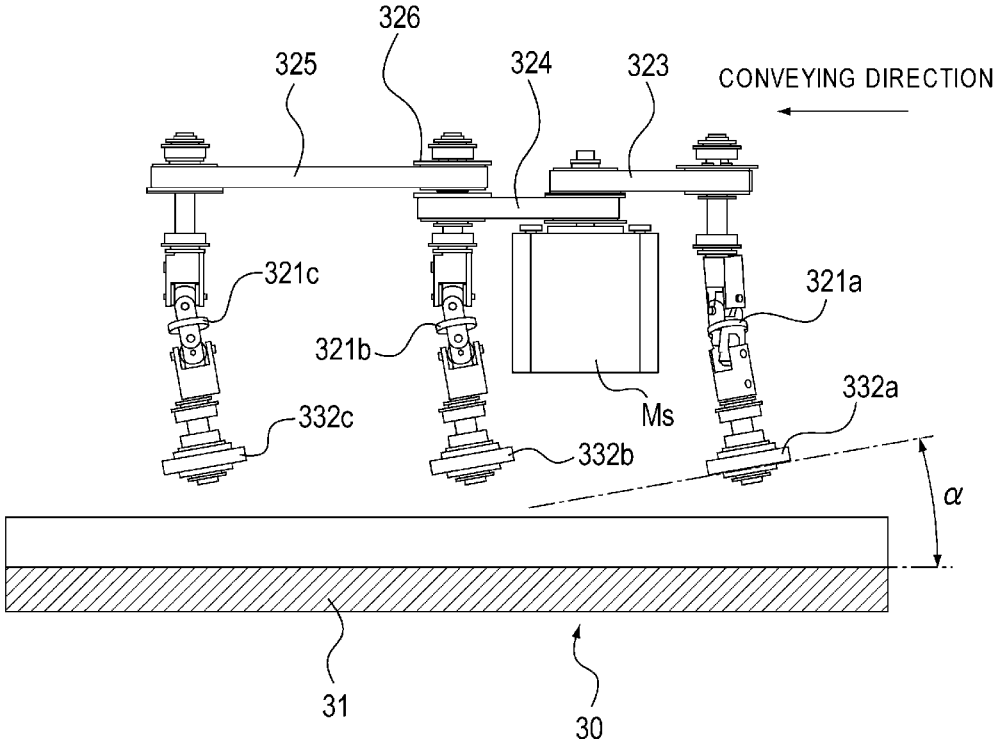
FIG. 7 is a plan view illustrating the drive portion for driving the pairs of skew-feed rollers of the skew feeding correction portion according to the embodiment of the present invention.
Figure 8A:
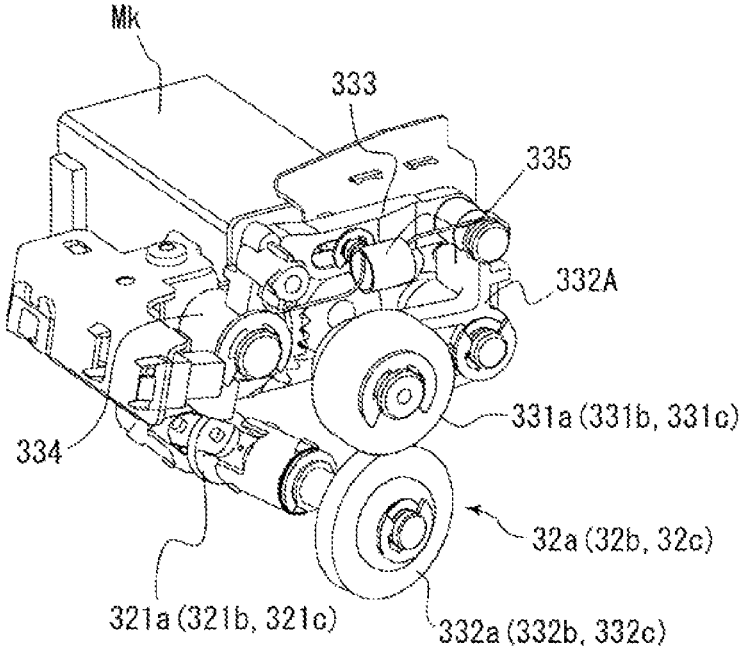
FIG. 8A is a perspective view for describing a moving mechanism of driven rollers that form the pairs of skew-feed rollers according to the embodiment of the present invention.
Figure 8B:
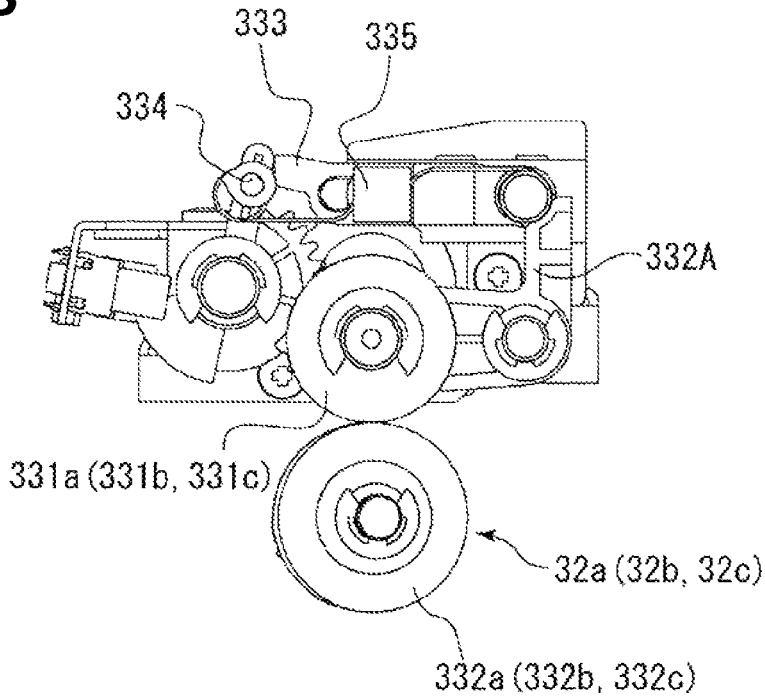
FIG. 8B is a side view for describing the moving mechanism of the driven rollers.
Figure 9A:
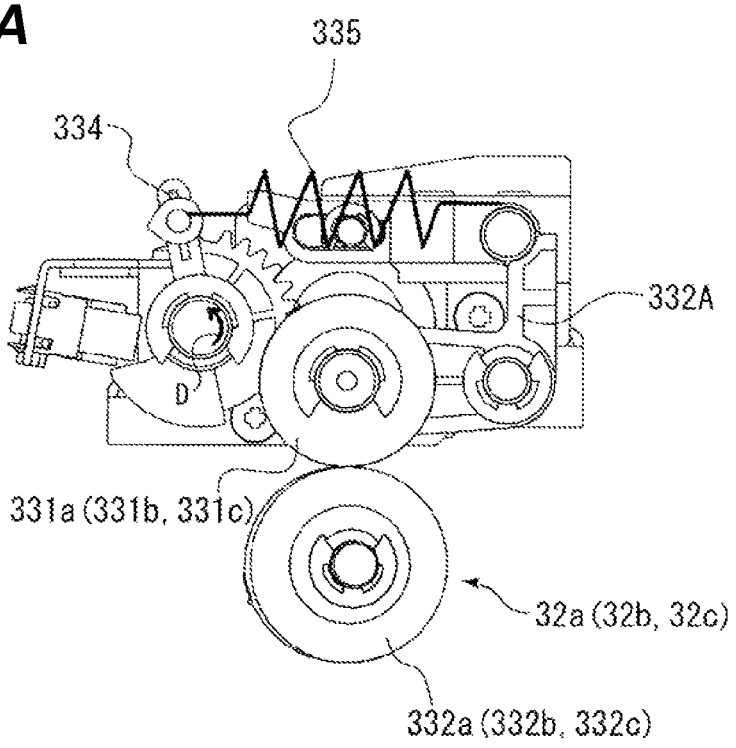
FIG. 9A is a view illustrating the nip state of the pairs of skew-feed rollers according to the embodiment of the present invention.
Figure 9B:
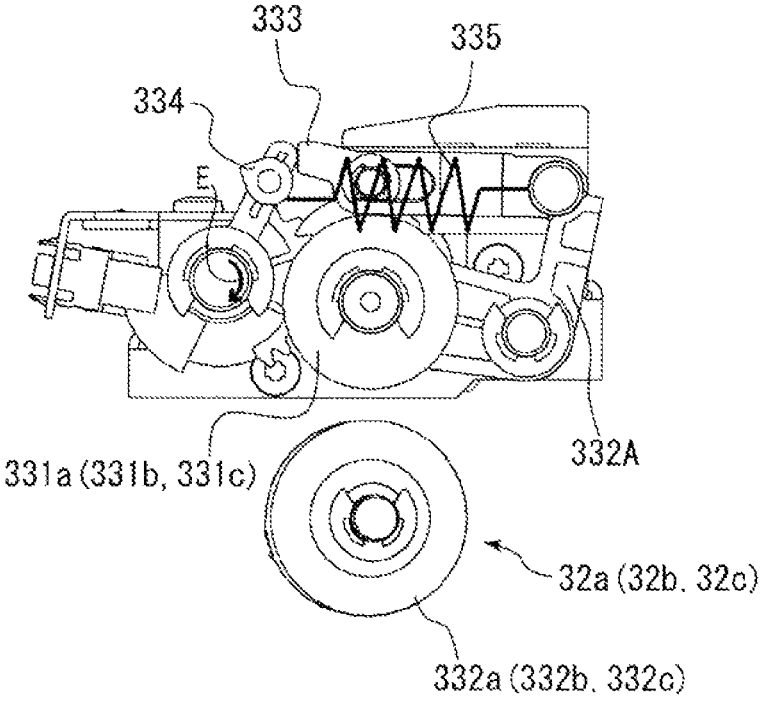
FIG. 9B is a view illustrating the nip release state of the pairs of skew-feed rollers.

2A to 3B. FIG. 7 is a plan view illustrating the drive portion for driving the first to third pairs of skew-feed rollers 32*a* to 32*c* of the skew feeding correction portion 55 according to the present embodiment. FIG. 8A is a perspective view for describing a moving mechanism of driven rollers 331*a* to 331*c* that form the first to third pairs of skew-feed rollers 32*a* to 32*c* according to the present embodiment, while FIG. 8B is a side view for describing the moving mechanism of the driven rollers 331*a* to 331*c*. FIG. 9A is a view illustrating the nip state of the first to third pairs of skew-feed rollers 32*a* to 32*c* according to the present embodiment, while FIG. 9B is a view illustrating the nip release state of the first to third pairs of skew-feed rollers 32*a* to 32*c*.

The skew feeding correction portion 55 according to the present embodiment performs a correction of the skew feeding on a side-registration basis for correcting a positional deviation of the sheet with the side end of the currently-conveyed sheet S being defined as a reference. The skew feeding correction portion 55 is arranged at the upstream side of the secondary transfer portion 515.

As illustrated in FIG. 2A, the skew feeding correction portion 55 includes a fixed guide 33 that functions as a conveying guide of the sheet S, and a skew feeding portion 30 that is movable in the width direction (the direction of C in FIG. 2A) according to the size of the sheet S to be conveyed. The skew feeding portion 30 includes the first pair of skew-feed rollers 32*a*, the second pair of skew-feed rollers 32*b*, and the third pair of skew-feed rollers 32*c*, wherein the first to third pairs of skew-feed rollers 32*a* to 32*c* are arranged in this order along the sheet conveying direction from the upstream side.

The first to third pairs of skew-feed rollers 32*a* to 32*c* are attached to the skew feeding portion 30 as being tilted (skewed) by an angle α with respect to a sub-scanning direction (conveying direction) in order to obtain an abutment conveying component against a later-described reference member 31 that positions a side end of the sheet S.

As illustrated in FIGS. 3A and 3B, the first to third pairs of skew-feed rollers 32*a* to 32*c* include driving rollers 332*a* to 332*c*, and driven rollers 331*a* to 331*c* that can be brought into contact with or can be separated from the driving rollers 332*a* to 332*c*. The first to third pairs of skew-feed rollers 32*a* to 32*c* allow the driven rollers 331*a* to 331*c* to be brought into contact with or separated from the driving rollers 332*a* to 332*c*, thereby realizing the changeover between the nip state for nipping the sheet S and the nip release state for releasing the nip of the sheet S. The driving rollers 332*a* to 332*c* are made of a rubber material such as a natural rubber or synthetic rubber, while the driven rollers 331*a* to 331*c* are made of a metallic bearing.

As illustrated in FIG. 7, the driving rollers 332*a* to 332*c* are connected to a pulley 326 via universal joints 321*a* to 321*c*, wherein the pulley 326 is connected to a skew feeding drive motor Ms via the conveying belts 323 to 325. The driving rollers 332*a* to 332*c* are driven by the skew feeding drive motor Ms thus connected. The skew feeding drive motor Ms is a stepping motor, and it can change a stop timing or rotation speed according to a predetermined timing.

As illustrated in FIGS. 8A and 8B, each of the driven rollers 331*a* to 331*c* includes a link 332A, a pressure gear 334, a pressure spring 335, and a skew feeding pressure motor Mk. The link 332A supports the driven rollers 331*a* to 331*c* so as to be rotatable. The pressure spring 335 is provided between the link 332A and the pressure gear 334. The skew feeding pressure motor Mk rotates the pressure gear 334. The link 332A, the pressure gear 334, the pressure spring 335, and the skew feeding pressure motor Mk form a moving mechanism of the driven rollers 331*a* to 331*c*.

The first to third pairs of skew-feed rollers 32*a* to 32*c* set a nip pressure (sheet nip pressure) between the driven rollers 331*a* to 331*c* and the driving rollers 332*a* to 332*c* by rotating the pressure gear 334 by a predetermined angle by the skew feeding pressure motor Mk. Specifically, with the state in which the driven rollers 331*a* to 331*c* are in pressed contact with the driving rollers 332*a* to 332*c*, the pressure gear 334 rotates in a direction of D in FIG. 9A, and stops as pulling the pressure spring 335. The link 332A is pulled by the pressure gear 334 through the pressure spring 335. When the link 332A is pulled as described above, the driven rollers 331*a* to 331*c* are brought into pressed contact with the driving rollers 332*a* to 332*c*.

On the other hand, during the nip release, the pressure gear 334 rotates in a direction of E in FIG. 9B, and stops with this state. When the pressure gear 334 rotates in the direction of E, the pressure gear 334 is configured to push the link 332A through the link 333. The driven rollers 331*a* to 331*c* move in the direction of releasing the nip (upward in FIG. 9B), when the link 332A is pushed. The skew feeding pressure motor Mk is a stepping motor. When it sets a step angle, the nip pressure of the pairs of skew-feed rollers 32*a* to 32*c* can be changed. In the present embodiment, the moving mechanism is provided to each of the driven rollers 331*a* to 331*c*, so that the nip pressure of the pairs of skew-feed rollers 32*a* to 32*c* can be independently set.

An abutment reference member 31 (hereinafter referred to as a "reference member") on which the sheet S, which is fed as being skewed by the first to third pairs of skew-feed rollers 32*a* to 32*c*, abuts, is provided to the skew feeding portion 30. The reference member 31 has a reference surface formed so as to be substantially parallel to the conveying direction of the sheet S. The side end of the sheet S, which is fed as being skewed by the first to third pairs of skew-feed rollers 32*a* to 32*c*, abuts against the reference surface (see later-described FIG. 11).

Figure 10A:
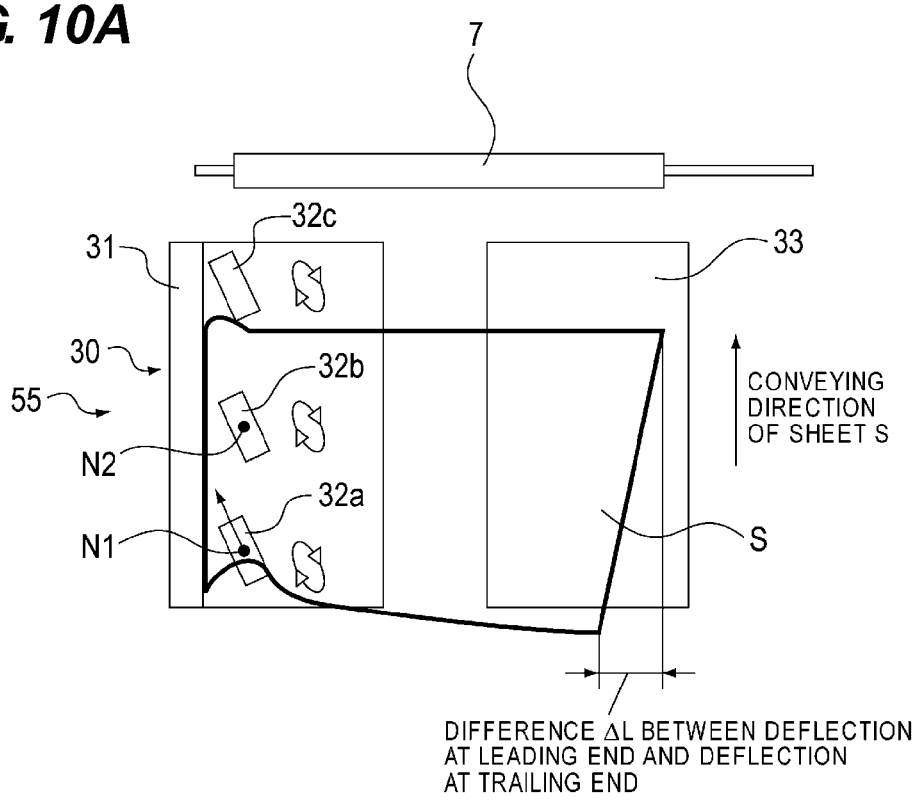
FIG. 10A is a plan view illustrating the state in which a sheet, which is conveyed as being skewed, passes through the skew feeding correction portion according to the embodiment of the present invention.
Figure 10B:
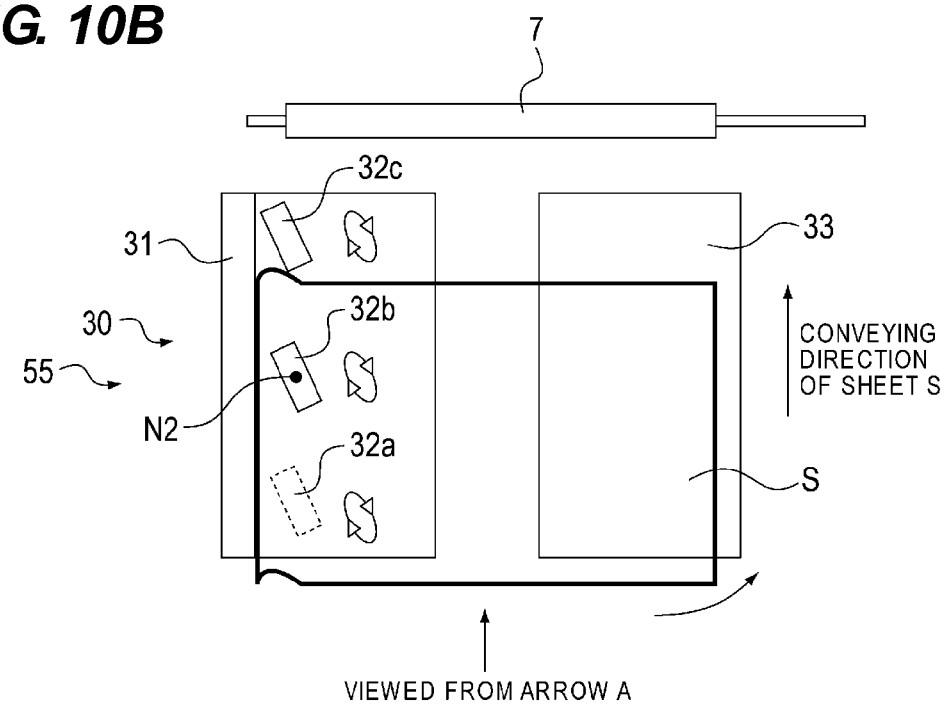
FIG. 10B is a plan view illustrating the state in which the skew feeding of the sheet is corrected.
Figure 11:
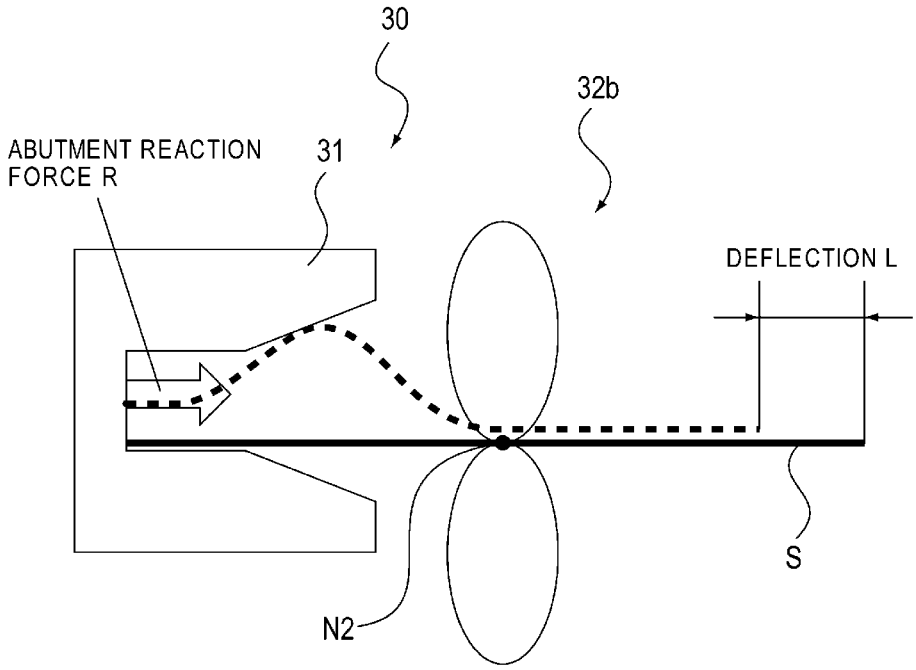
FIG. 11 is a view of the skew feeding correction portion illustrated in FIG. 10B, as viewed from an arrow A.
Figure 12:
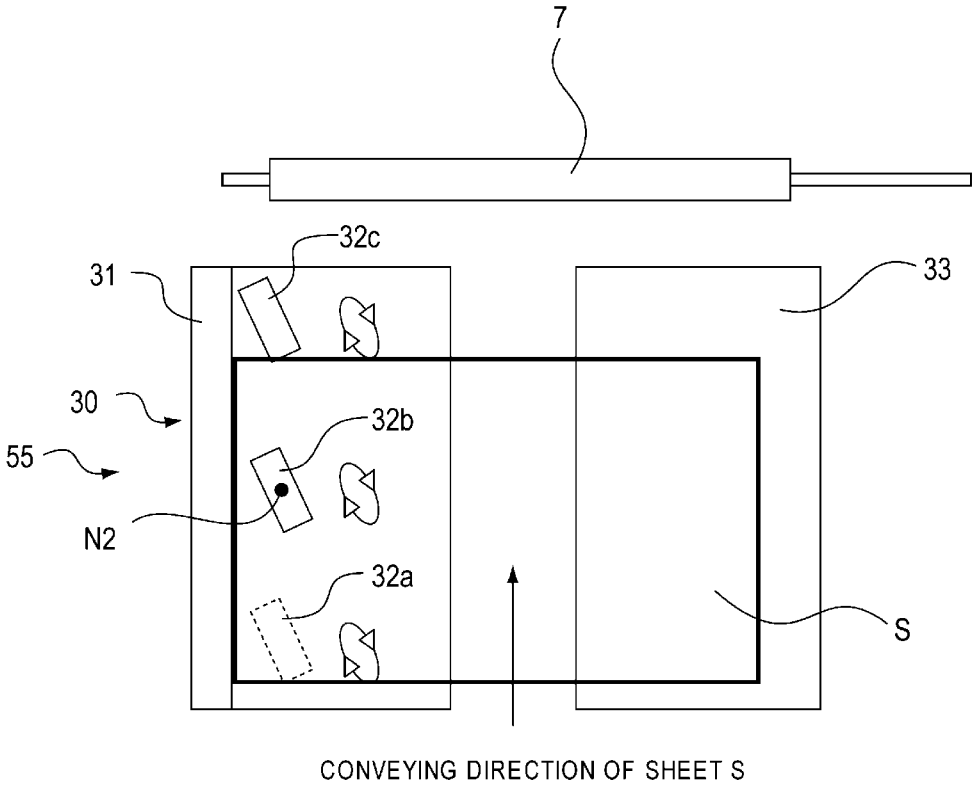
FIG. 12 is a plan view illustrating the state in which the skew feeding of the sheet is corrected by the skew feeding correction portion according to the embodiment of the present invention.
Figure 13:
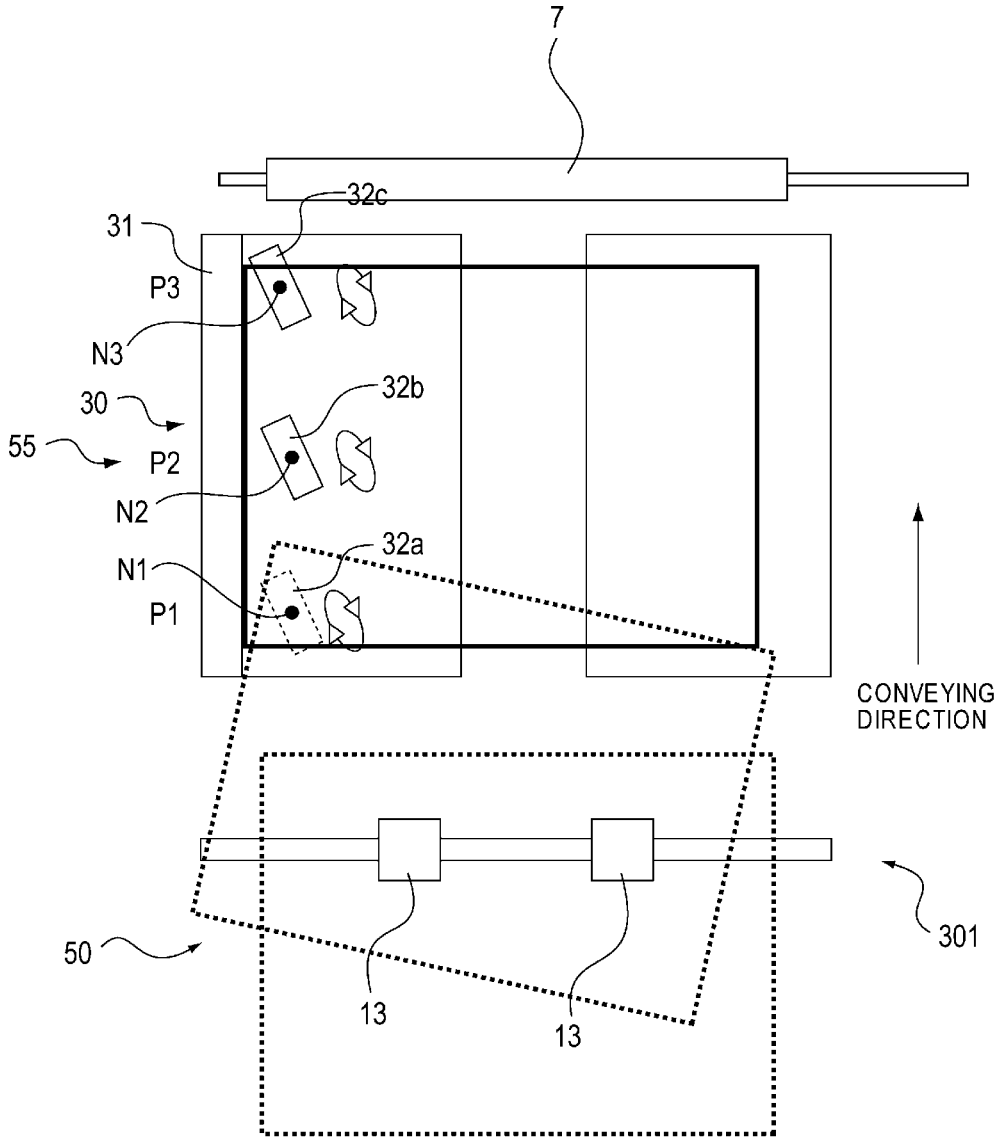
FIG. 13 is a view for describing the relationship among the nip pressures of the first to third pairs of skew-feed rollers of the skew feeding correction portion according to the embodiment of the present invention.

An operation of the sheet aligning portion 150 according to the present embodiment will next be described with reference to FIGS. 10A to 13 in addition to FIGS. 2A to 2D. FIG. 10A is a plan view illustrating the state in which the sheet S, which is conveyed as being skewed, passes through the skew feeding correction portion 55 according to the present embodiment. FIG. 10B is a plan view illustrating the state in which the skew feeding of the sheet S is corrected. FIG. 11 is a view of the skew feeding correction portion 55 illustrated in FIG. 10B, as viewed from an arrow A. FIG. 12 is a plan view illustrating the state in which the skew feeding of the sheet S is corrected by the skew feeding correction portion 55 according to the present embodiment. FIG. 13 is a view for describing the relationship among the nip pressures of the first to third pairs of skew-feed rollers 32*a* to 32*c* of the skew feeding correction portion 55 according to the present embodiment.

When the sheet S is conveyed from the conveying unit 54 to the conveying roller portion 50 with a skew feeding angle β as illustrated in FIG. 2A, the sheet S is conveyed to the skew feeding correction portion 55 as being skewed by the pairs of conveying rollers 34. The sheet S conveyed to the skew feeding correction portion 55 is nipped by the first pair of skew-feed rollers 32*a*. When the sheet S is nipped by the first pair of skew-feed rollers 32*a*, the sheet S is turned by the first pair of skew-feed rollers 32*a*. The turned sheet S is conveyed on a skew toward the reference member 31 as illustrated in FIG. 2B. The nips of the pairs of conveying rollers 34 are released after the sheet S reaches the first pair of skew-feed rollers 32*a* and before the sheet S reaches the second pair of skew-feed rollers 32*b*.

When the sheet S, which is conveyed as being skewed by the first pair of skew-feed rollers 32*a*, reaches the second pair of skew-feed rollers 32*b* and is nipped by the second pair of skew-feed rollers 32*b*, the first pair of skew-feed rollers 32*a* is separated from each other to release the nip N1.

In this case, the sheet S is conveyed on a skew toward the reference member 31 by the first pair of skew-feed rollers 32*a* as illustrated in FIG. 10A, the difference ΔL between the deflection at the leading end and the deflection at the trailing end is generated at the side end of the sheet S because of the abutment of the sheet S against the reference member 31. However, as illustrated in FIG. 10B, the sheet S easily turns about a nip N2, since the nip N1 is released owing to the separation of the first pair of skew-feed rollers 32*a*, and the sheet S is nipped only by the nip N2 by the second pair of skew-feed rollers 32*b*. The sheet S turns about the nip N2, and further, the sheet S follows the reference surface of the reference member 31, whereby the correction of eliminating the deflection difference ΔL is performed.

The skew feeding of the sheet S is corrected by the above-mentioned operation, but a deflection L is caused on the side end of the sheet S as illustrated in FIG. 10B. However, as illustrated in FIG. 11, the nip N2 of the second pair of skew-feed rollers 32*b* only allows the sheet S to slip owing to an abutment reaction force R from the reference surface of the reference member 31, whereby the deflection L in the abutment direction is released (see FIG. 12). If the skew feeding correction is not sufficiently performed, the third pair of skew-feed rollers 32*c* arranged at the downstream side of the second pair of skew-feed rollers 32*b* executes the similar skew feeding correction. Therefore, the precision in the skew feeding correction is enhanced. For example, a super thin sheet such as a coated paper having a basis weight of 80 (gsm) has weak stiffness in the direction of abutting the sheet S. Therefore, it is effective to correct the skew feeding in such a manner that the deflection difference ΔL and the deflection L are gradually released. Accordingly, the method described above is preferable.

The relationship among the nip pressures of the nips N1, N2, and N3 of the first to third pairs of skew-feed rollers 32*a* to 32*c* will be described with reference to FIG. 13. As illustrated in FIG. 13, the nip pressure of the nip N1 of the first pair of skew-feed rollers 32*a* is defined as P1, the nip pressure of the nip N2 of the second pair of skew-feed rollers 32*b* is defined as P2, and the nip pressure of the nip N3 of the third pair of skew-feed rollers 32*c* is defined as P3. When the nip pressures of the first to third pairs of skew-feed rollers 32*a* to 32*c* are set so as to increase toward the downstream side in the conveying direction of the sheet S, such as P1≤P2≤P3, the conveying force of the first to third pairs of skew-feed rollers 32*a* to 32*c* increases from the sheet feeding side toward the sheet discharge side.

For example, the second pair of skew-feed rollers 32*b* has the driving roller 332*b* that is a rubber roller, and the opposing driven roller 331*b* made of a metallic bearing. Therefore, when the driven roller 331*b* is pressed against the driving roller 332*b*, the rubber portion of the driving roller 332*b* is deformed. When the rubber roller rotates at the same speed (angular speed), the nipped sheet is conveyed faster for the deformed portion of the rubber roller, in general. Similarly, when the nip pressure is high, the conveying speed of the sheet increases.

When the nip pressure P2 of the second pair of skew-feed rollers 32*b* at the downstream side satisfies P1≤P2, the driving roller 332*b* of the second pair of skew-feed rollers 32*b* is deformed more than the driving roller 332*a* of the first pair of skew-feed rollers 32*a*. As a result, the rotation speed of the second pair of skew-feed rollers 32*b* increases more than the rotation speed of the first pair of skew-feed rollers 32*a*, whereby the posture of the turning sheet S can promptly be returned to be substantially parallel to the reference member 31. Since the third pair of skew-feed rollers 32*c* satisfies P2≤P3, the posture of the sheet can similarly be stabilized.

After the sheet S abuts against the reference surface of the reference member 31 at the skew feeding correction portion 55, and the skew feeding correction of the sheet S is completed, the first to third pairs of skew-feed rollers 32*a* to 32*c* are respectively separated from each other to release the nips as illustrated in FIG. 2C. The sheet S released from the nip is conveyed to the pair of registration rollers 7 at a predetermined timing. The skew feeding portion 30 moves in the direction (width direction of the sheet S) orthogonal to the conveying direction of the sheet S as illustrated in FIG. 2D.

Figure 14:
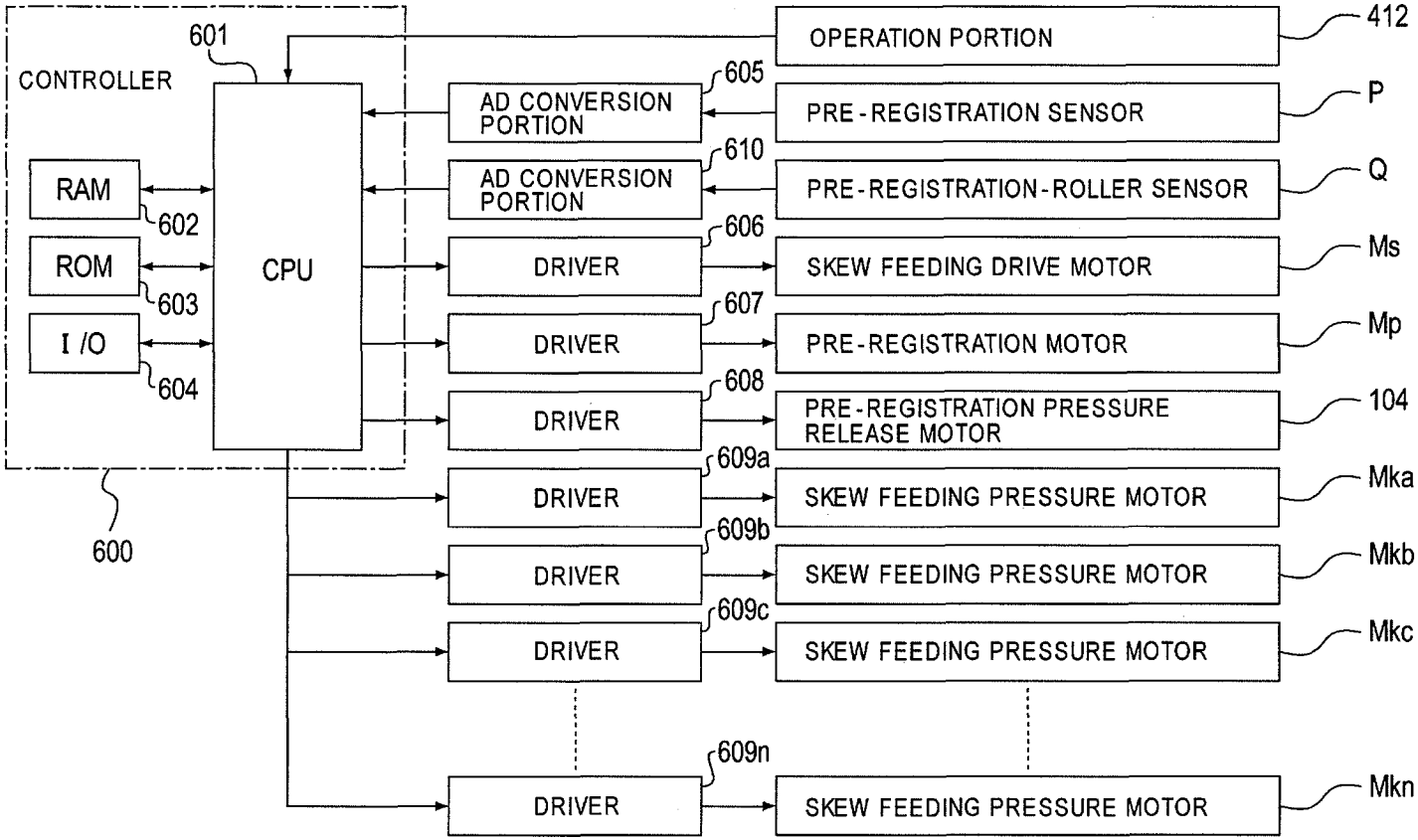
FIG. 14 is a block diagram illustrating a controller that forms and releases the nip pressure of each of n pairs of skew-feed rollers provided in the skew feeding correction portion according to the embodiment of the present invention.

A controller 600 for forming and releasing the nip pressure by the first to third pairs of skew-feed rollers 32*a* to 32*c* of the skew feeding correction portion 55 will next be described. FIG. 14 is a block diagram illustrating the controller 600 that forms and releases the nip pressure of each of n pairs of skew-feed rollers provided in the skew feeding correction portion 55 according to the present embodiment.

In the present embodiment, the skew feeding correction portion 55 having the first to third pairs of skew-feed rollers 32*a* to 32*c* has been described. However, the controller 600 can be used for a skew feeding correction portion having plural pairs, e.g., n pairs of skew-feed rollers. Therefore, the controller 600 used for the skew feeding correction portion having n pairs of skew-feed rollers will be described.

As illustrated in FIG. 14, the controller 600 includes a CPU 601, a ROM 603 that stores programs and the like, a RAM 602 that temporarily stores data, and an I/O 604 used for communication. The controller 600 recognizes a size, a basis weight (gsm), and number of the sheet S, when a user inputs sheet information of the sheet S to be used such as the size, the basis weight (gsm) and the number of sheets from an operation portion 412.

The controller 600 also controls the skew feeding pressure motors Mka to Mkn via the drivers 609*a* to 609*n* by a timing signal acquired by the pre-registration sensor P via the AD conversion portion 605 and a timing signal acquired by a pre-registration-roller sensor Q via the AD conversion portion 610. Specifically, the controller 600 controls the skew feeding pressure motors Mka to Mkn to form and release the nip pressures of the driven rollers of the pairs of skew-feed rollers.

The controller 600 also controls the skew feeding drive motor Ms through the driver 606 so as to control the pre-registration motor Mp via the driver 607 and so as to control the pre-registration pressure release motor 104 via the driver 608, thereby controlling the formation of the nip pressure and release of the nip pressure of the driven roller 14 of the conveying roller portion 50.

Figure 15:
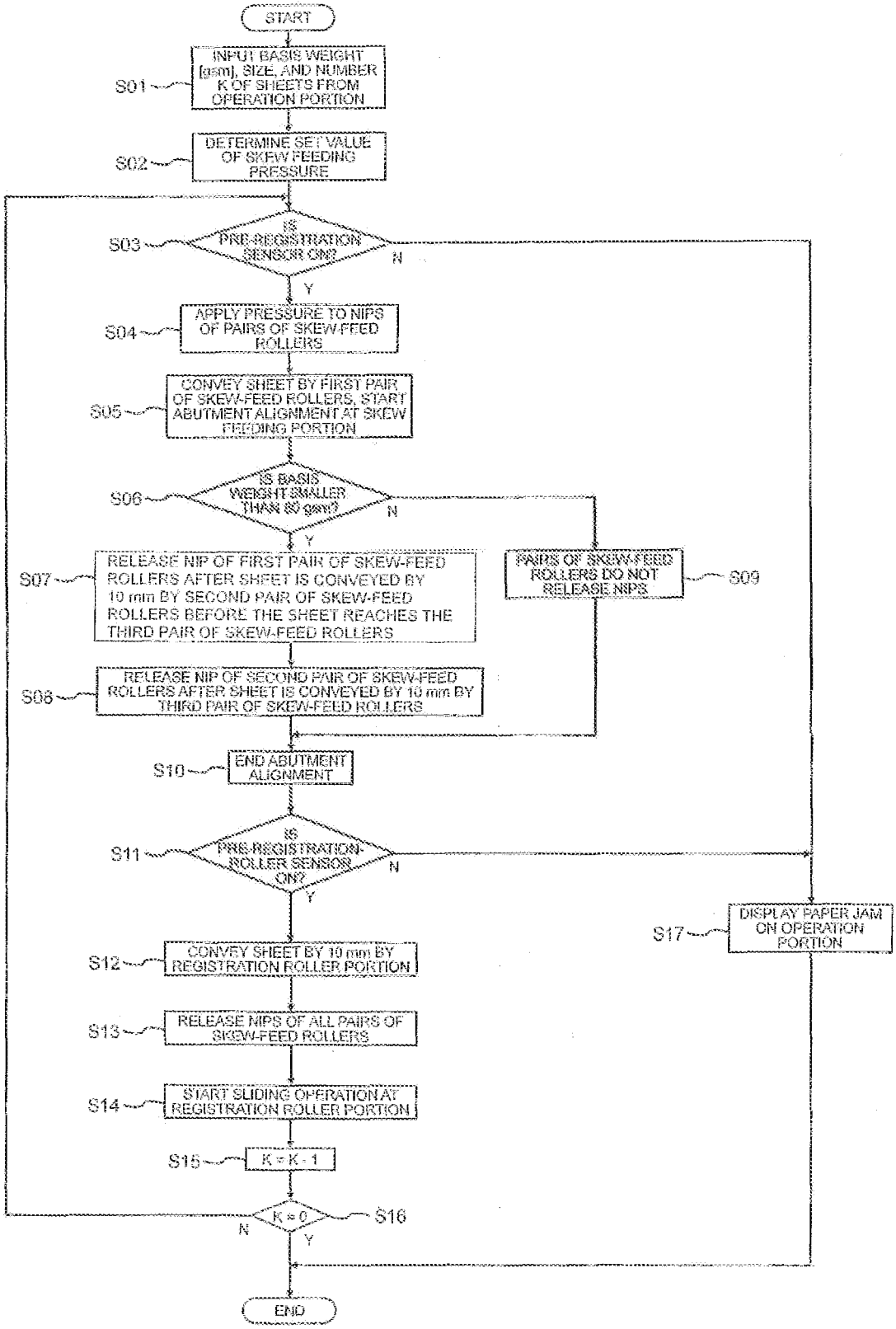
FIG. 15 is a flowchart illustrating the skew feeding correction operation when the skew feeding correction portion according to the embodiment of the present invention has three pairs of skew-feed rollers.
Figure 16:
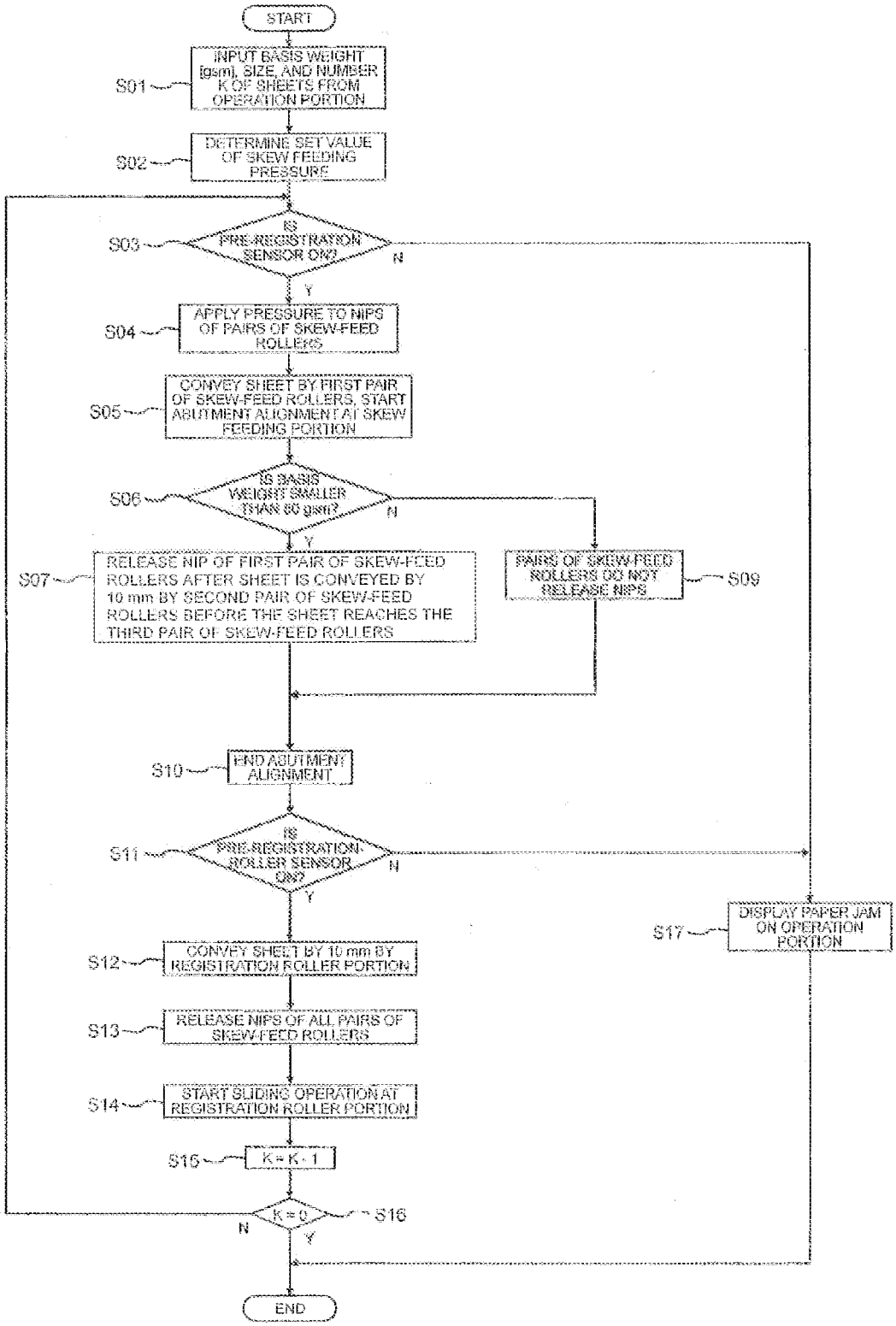
FIG. 16 is a flowchart illustrating the skew feeding correction operation when the skew feeding correction portion according to the embodiment of the present invention releases only a nip of the first pair of skew-feed rollers.
Figure 17:
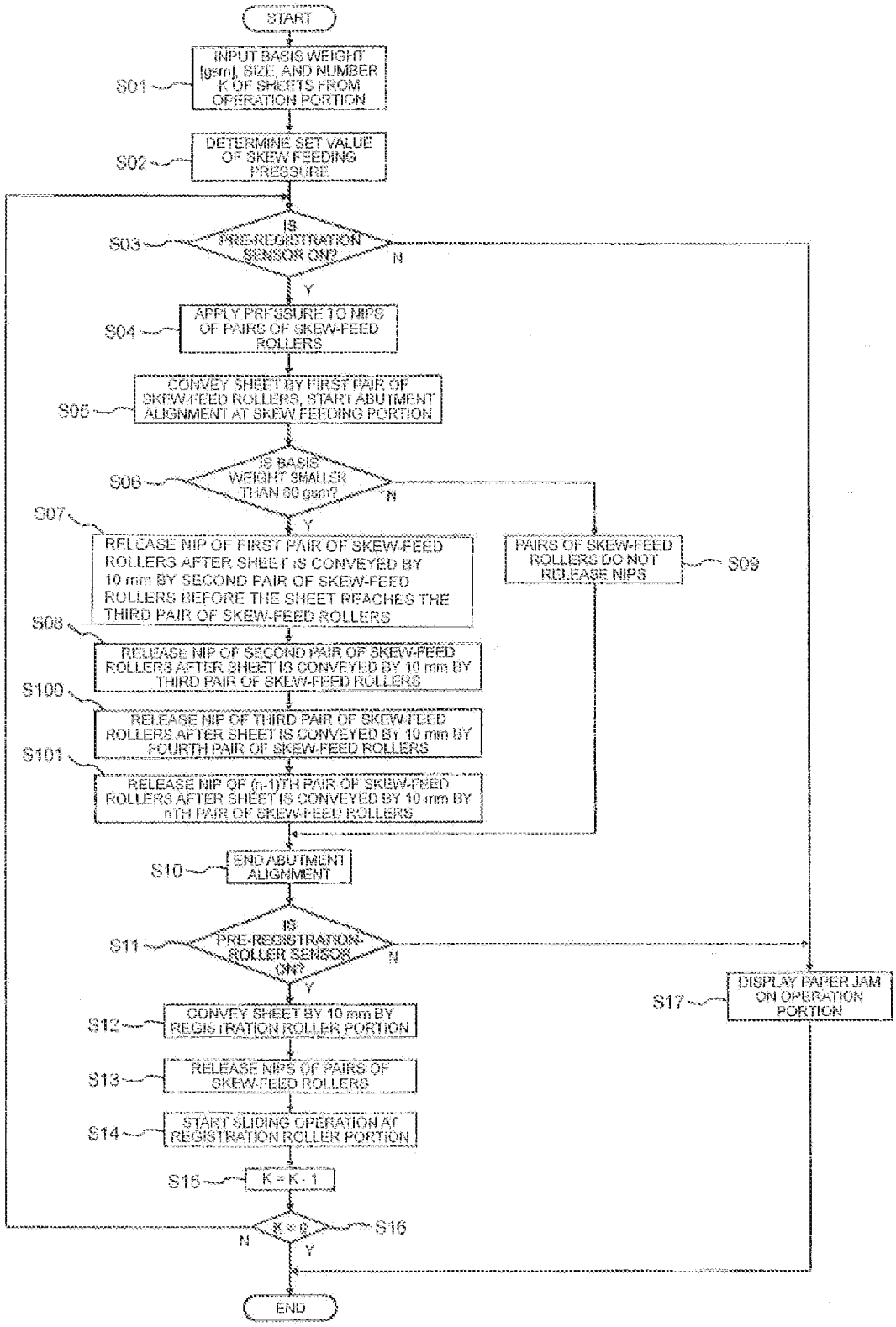
FIG. 17 is a flowchart illustrating the skew feeding correction operation when the skew feeding correction portion according to the embodiment of the present invention has n pairs of skew-feed rollers.
Figure 18A:
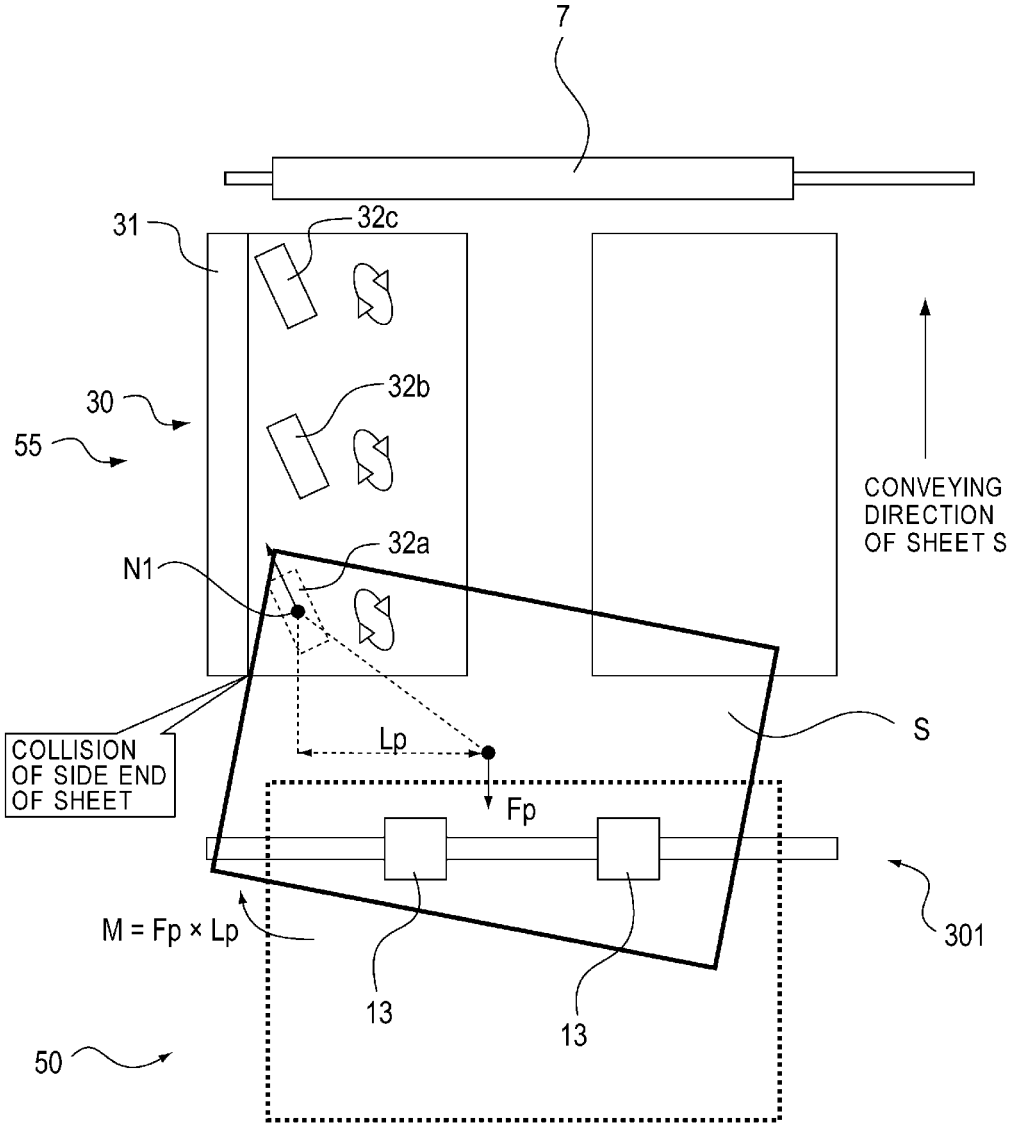
FIG. 18A PRIOR ART
FIG. 18A is a view illustrating a sheet whose skew feeding is corrected by a skew feeding correction portion provided to a sheet conveying apparatus in an image forming apparatus in prior art.
Figure 18B:
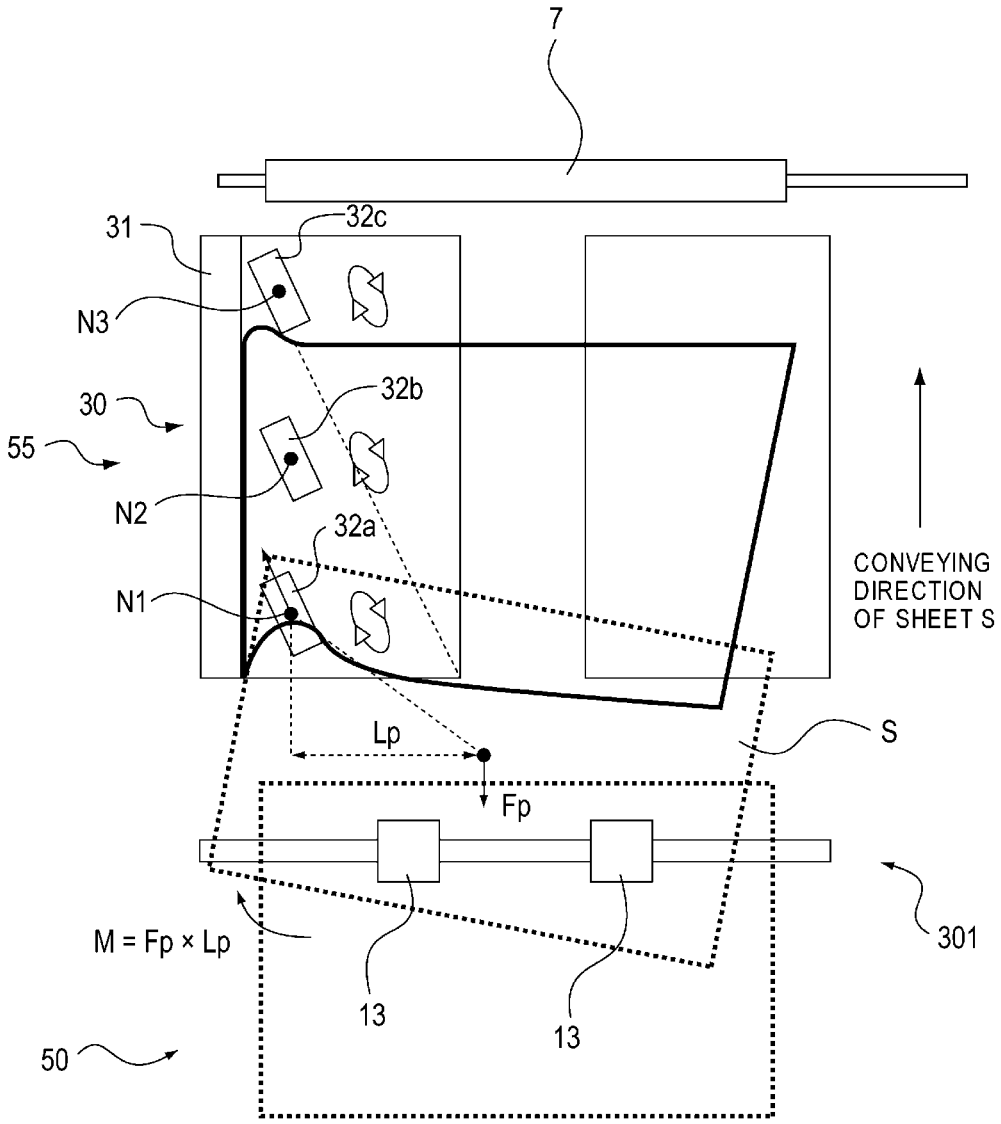
FIG. 18B PRIOR ART
FIG. 18B is a view illustrating a sheet whose skew feeding is corrected by a skew feeding correction portion provided to a sheet conveying apparatus in an image forming apparatus in prior art.

The skew feeding correction operation of the skew feeding correction portion 55 by the controller 600 according to the present embodiment will be described with reference to flowcharts in FIGS. 15 to 17. The skew feeding correction operation when the skew feeding correction portion 55 has three pairs of skew-feed rollers will firstly be described. FIG. 15 is a flowchart illustrating the skew feeding correction operation when the skew feeding correction portion 55 according to the present embodiment has three pairs of skew-feed rollers.

As illustrated in FIG. 15, when a user inputs the basis weight (gsm) and the size of the sheet S and the number of sheets to be conveyed from the operation portion 412 (step S01), the controller 600 recognizes the input sheet information. After recognizing the sheet information, the controller 600 determines set values of the nip pressure forces (skew feeding forces) of the first to third pairs of skew-feed rollers 32*a* to 32*c* according to the basis weight and the size of the sheet S (step S02), and then, starts the feeding.

When the sheet S reaches the conveying roller portion 50, and the pre-registration sensor P detects (ON) the leading end of the sheet S (step S03) as illustrated in FIG. 3A, the controller 600 temporarily stops the pre-registration motor Mp so as to adjust the sheet-to-sheet period (variation in the sheet conveying time). On the other hand, when the pre-registration sensor P does not detect the leading end of the sheet S in step S03, the controller 600 displays a paper jam (delay jam) on the operation portion 412 (step S17), and ends the process.

After finishing the adjustment of the sheet-to-sheet period, the pre-registration motor Mp is restarted for conveying the sheet S to the skew feeding portion 30 as illustrated in FIG. 3B. Specifically, the driven rollers 331*a*, 331*b*, and 331*c* of the first to third pairs of skew-feed rollers 32*a*, 32*b*, and 32*c* are driven at a timing before the leading end of the sheet S reaches the pairs of skew-feed rollers after the pre-registration sensor P detects (ON) the leading end of the sheet S. The controller 600 applies pressure to the nips of the first to third pairs of skew-feed rollers 32*a*, 32*b*, and 32*c* until the nip pressures of these roller pairs assume the set values of the skew feeding pressure determined in step S02 (step S04). The pressure may simultaneously be applied to the nips, or may be sequentially applied from the roller pair at the upstream side in the conveying direction.

After the sheet S is conveyed to the skew feeding portion 30, the controller 600 drives the driven rollers 14 of the pairs of conveying rollers 34 of the conveying roller portion 50 so as to release the nips of all of the pairs of conveying rollers 34, and then, starts the abutment alignment of the sheet S by the skew feeding portion 30 (step S05). When the basis weight of the sheet S is less than 80 (gsm) (step S06), the controller 600 releases the nip of the first pair of skew-feed rollers 32*a* after the sheet S is conveyed by 10 mm after the leading end of the sheet is nipped by the second pair of skew-feed rollers 32*b* (step S07).

Similarly, the controller 600 releases the nip of the second pair of skew-feed rollers 32*b* after the sheet S is conveyed by 10 mm after the leading end of the sheet S is nipped by the third pair of skew-feed rollers 32*c* (step S08). The timing of releasing the nips of the first pair of skew-feed rollers 32*a* and the second pair of skew-feed rollers 32*b* is set according to a (soft count) value of a time obtained by dividing the distance between the pre-registration sensor P and each of the pairs of skew-feed rollers by the conveying speed at the skew feeding portion 30. Thereafter, the sheet S is nipped by the third pair of skew-feed rollers 32*c* as illustrated in FIG. 4, whereby the abutment aligning operation of the sheet S is completed (step S10).

On the other hand, when the basis weight of the sheet S is 80 or more (gsm) in step S06, the abutment aligning operation of the sheet S is executed without releasing the nips of the first to third pairs of skew-feed rollers 32*a* to 32*c* (step S09).

Next, when the pre-registration-roller sensor Q detects (ON) the leading end of the sheet S (step S11), the sheet S is nipped by the pair of registration rollers 7 and conveyed by 10 mm with this state (step S12), and then, all nips are released (step S13). A lateral sliding operation is started at the pair of registration rollers 7 (step S14).

The timing of releasing the nips of the third pair of skew-feed rollers 32*c* is set according to a soft count value of a time obtained by adding a time required for conveying the sheet S by 10 mm by the pair of registration rollers 7 to a time obtained by dividing the distance between the pre-registration-roller sensor Q and the pair of registration rollers 7 by the conveying speed at the skew feeding portion 30. On the other hand, when the pre-registration-roller sensor Q does not detect (ON) the leading end of the sheet S in step S11, the controller 600 displays the paper jam (delay jam) on the operation portion 412 (step S17), and ends the process.

Next, a feed counter counts a count number of K=K−1 (step S15). If the count number K is not 0, the pressure is again applied to the pair of conveying rollers 34 to feed the sheet at the timing when the alignment of the sheet S at the first to third pairs of skew-feed rollers 32*a* to 32*c* is completed. On the other hand, when the count number K is 0 (step S16), the process is ended.

The skew feeding correction operation when the skew feeding correction portion 55 releases only the nip N1 of the first pair of skew-feed rollers 32*a* will be described. FIG. 16 is a flowchart illustrating the skew feeding correction operation when the skew feeding correction portion 55 according to the present embodiment releases only the nip N1 of the first pair of skew-feed rollers 32*a*.

The operation of releasing the nip of the first pair of skew-feed rollers 32*a* is the same as the above-mentioned operation of releasing the nip of the first pair of skew-feed rollers 32*a* after the pressure is applied to the nip of the second pair of skew-feed rollers 32*b* and the sheet S is conveyed by 10 mm with this state. Therefore, the description will not be repeated here (see steps S01 to S17).

The present embodiment is well adaptable to a coated paper, among super thin papers, having relatively a certain stiffness, such as a coated paper having a basis weight of 70 or more (gsm) and less than (gsm). For example, pressure is applied to the nips of the second pair of skew-feed rollers 32*b* and the third pair of skew-feed rollers 32*c*. Therefore, in order to stably keep the posture of the sheet S, the sheet S is nipped by the nip N2 of the second pair of skew-feed rollers 32*b* and the nip N3 of the third pair of skew-feed rollers 32*c*, which stabilizes the posture of the sheet S. Accordingly, the present embodiment is well adaptable to the sheet S having a certain stiffness (e.g., having a basis weight of not less than 70 (gsm)) in order to realize both high precision in the skew feeding correction performance of the sheet S and the stability in conveying the sheet S.

For example, a short sheet with any basis weights (gsm) (length of the sheet S in the conveying direction<length in the direction orthogonal to the conveying direction) is susceptible to the moment M, so that it is easily turned, because the weight of the sheet is low. Therefore, the present embodiment is well adaptable to the case in which the turning degree is great as in the short paper, and the skew feeding correction of the short paper is further enhanced.

The control operation of the controller 600 for controlling the skew feeding correction portion 55 for four or more (n) pairs of skew-feed rollers will next be described with reference to FIG. 17. FIG. 17 is a flowchart illustrating the skew feeding correction operation when the skew feeding correction portion 55 according to the present embodiment has n pairs of skew-feed rollers.

The release timings of n pairs of skew-feed rollers 32*a* to 32*n* (the nip of the pair of skew-feed rollers at the upstream side is released after pressure is applied to the nip of the pair of skew-feed rollers at the downstream side) are the same as those for the first to third pairs of skew-feed rollers 32*a* to 32*c*. Therefore, the description thereof will not be repeated here.

The controller 600 releases the nip of the third pair of skew-feed rollers 32*c* after the sheet S is conveyed by 10 mm after the leading end of the sheet is nipped by the fourth pair of skew-feed rollers 32*d* (step S100). The controller 600 releases the nip of the (n−1)th pair of skew-feed rollers (n−1) after the sheet S is conveyed by 10 mm after the leading end of the sheet S is nipped by the nth pair of skew-feed rollers (n) (step S101). The subsequent operation is the same as that for the first to third pairs of skew-feed rollers 32*a* to 32*c*, so that the description will not be repeated here (steps S10 to S16, S17).

The image forming apparatus 100 thus configured according to the present embodiment has effects described below. The image forming apparatus 100 according to the present embodiment controls to release the nip of the sheet S by the (n−1)th pair of skew-feed rollers (n−1), when the nth pair of skew-feed rollers n arranged at the downstream side nips the sheet S that is conveyed on a skew by the (n−1)th pair of skew-feed rollers (n−1) at the upstream side. For example, the image forming apparatus 100 controls to release the nip of the sheet S by separating the driven roller from the driving roller of the first pair of skew-feed rollers 32*a*, when the second pair of skew-feed rollers 32*b* nips the sheet S that is conveyed on a skew by the first pair of skew-feed rollers 32*a*. By virtue of this, the deflection difference ΔL and the deflection L itself in the sheet conveying direction can gradually be eliminated, whereby the performance of the skew feeding correction and the sheet conveyance stability can be enhanced. Even a sheet having low stiffness can be subject to the skew feeding correction, whereby the stable skew feeding correction of the sheet S can be executed, regardless of a type of sheet. Accordingly, a media such as a super thin sheet can be handled.

In the conventional case, the effect of the first pair of skew-feed rollers 32*a* due to the turning of the sheet upon the advance of the sheet to the reference member 31 is larger than the effect of the second pair of skew-feed rollers or third pair of skew-feed rollers (nth pair of skew-feed rollers (n)). Further, the time for applying pressure to the nip of the first pair of skew-feed rollers is the longest (so pressure is applied for longer to the first pair of skew-feed rollers). Therefore, the durability life of the drive rubber roller of the first pair of skew-feed rollers is relatively short. However, in the present embodiment, the nip of the first pair of skew-feed rollers is frequently released, whereby the durability life of the first pair of skew-feed rollers 32*a* can be increased. Consequently, cost for components can be reduced, and a cost for maintenance can also be reduced.

In the present embodiment, when the sheet S abuts on the reference member 31 to perform the abutment alignment of the sheet S, the nip of the sheet S by the (n−1)th pair of skew-feed rollers (n−1) at the upstream side is released after the nth pair of skew-feed rollers n at the downstream side nips the sheet. Specifically, the sheet S is not nipped by plural pairs of skew-feed rollers, but by a single pair of skew-feed rollers. Therefore, even if a force for pressing the sheet S toward the reference surface is too strong, which causes a deflection at the side end of the sheet S, the image forming apparatus 100 can allow the deflection caused at the side end to slip, thereby easily eliminating the deflection. Since the deflection caused at the side end of the sheet S can be eliminated, the posture of the sheet S upon the abutment alignment can be along the sheet conveying direction. Accordingly, the performance of the skew feeding correction for a super thin sheet can be enhanced, and the conveyance stability upon the alignment of the sheet S can be enhanced (stability in conveying a sheet can be enhanced). Since the nip of the pair of skew-feed rollers is released, the durability of the rollers in the pair of skew-feed rollers can be enhanced.

Although the embodiments of the present invention have been described above, the present invention is by no means limited to the above-described embodiments. Further, the most exemplary effects produced from the present invention have only been described as the effects discussed in the embodiments of the present invention, and the effect of the present invention is by no means limited to the effect discussed in the embodiments of the present invention.

For example, in the present embodiment, the skew feeding correction portion 55 is arranged at the upstream side of the secondary transfer portion 515, but the present invention is not limited thereto. The skew feeding correction portion can be arranged at the position other than the upstream side of the secondary transfer portion 515. For example, the skew feeding correction portion can be arranged at the upstream side of a sheet post-processing apparatus in a discharge system after a fixing operation.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-232690, filed Oct. 15, 2010, which is hereby incorporated by reference herein in its entirety.

What is claimed is:

1. A sheet conveying apparatus comprising a skew feeding correction portion arranged to correct a skew feeding of a sheet conveyed along a sheet conveying path in a sheet conveying direction, the skew feeding correction portion including:

a reference member extending in the sheet conveying direction;

a first pair of skew-feed rollers;

second pair of skew-feed rollers positioned downstream of the first pair of skew-feed rollers in the sheet conveying direction;

a third pair of skew-feed rollers positioned downstream of the second pair of skew-feed rollers in the sheet conveying direction;

wherein the first, second and third pairs of skew-feed rollers are each arranged to nip the sheet and to convey the sheet towards the reference member such that the sheet abuts the reference member to correct a skew of the sheet;

a moving mechanism arranged to move the first pair of skew-feed rollers between a nip position in which the first pair of skew-feed rollers are in contact with each other and a separate position in which the first pair of skew-feed rollers are separated from each other;

a controlling portion arranged to control the moving mechanism so as to move the first pair of skew-feed rollers from the nip position to the separate position after the sheet, conveyed by the first pair of skew-feed rollers, is nipped by the second pair of skew-feed rollers and before the sheet is nipped by the third pair of skew-feed rollers, wherein a nip pressure of the second pair of skew-feed rollers is set so that the sheet is slipped in a nip portion of the second pair of skew-feed rollers to release a deflection of the sheet caused between the reference member and the second pair of skew-feed rollers after the first pair of skew-feed rollers moves to the separate position.

2. The sheet conveying apparatus according to claim 1, wherein a nip pressure of the second pair of skew-feed rollers is set to be higher than a nip pressure of the first pair of skew-feed rollers.

3. The sheet conveying apparatus according to claim 2, wherein a nip pressure of the third pair of skew-feed rollers is set to be higher than the nip pressure of the second pair of skew-feed rollers.

4. The sheet conveying apparatus according to claim 1, wherein a nip pressure of the third pair of skew-feed rollers is set to be higher than a nip pressure of the first pair of skew-feed rollers.

5. An image forming apparatus comprising:

an image forming portion that forms an image on a sheet;

a skew feeding correction portion arranged to correct a skew feeding of a sheet conveyed along a sheet conveying path in a sheet conveying direction, the skew feeding correction portion including:

a reference member extending in the sheet conveying direction;

a first pair of skew-feed rollers;

second pair of skew-feed rollers positioned downstream of the first pair of skew-feed rollers in the sheet conveying direction;

a third pair of skew-feed rollers positioned downstream of the second pair of skew-feed rollers in the sheet conveying direction;

wherein the first, second and third pairs of skew-feed rollers are each arranged to nip the sheet and to convey the sheet towards the reference member such that the sheet abuts the reference member to correct a skew of the sheet;

a moving mechanism arranged to move the first pair of skew-feed rollers between a nip position in which the first pair of skew-feed rollers are in contact with each other and a separate position in which the first pair of skew-feed rollers are separated from each other;

a controlling portion arranged to control the moving mechanism so as to move the first pair of skew-feed rollers from the nip position to the separate position after the sheet, conveyed by the first pair of skew-feed rollers, is nipped by the second pair of skew-feed rollers and before the sheet is nipped by the third pair of skew-feed rollers, wherein a nip pressure of the second pair of skew-feed rollers is set so that the sheet is slipped in a nip portion of the second pair of skew-feed rollers to release a deflection of the sheet caused between the reference member and the second pair of skew-feed rollers after the first pair of skew-feed rollers moves to the separate position.

6. The image forming apparatus according to claim 5, wherein a nip pressure of the second pair of skew-feed rollers is set to be higher than a nip pressure of the first pair of skew-feed rollers.

7. The image forming apparatus according to claim 6, wherein a nip pressure of the third pair of skew-feed rollers is set to be higher than the nip pressure of the second pair of skew-feed rollers.

8. The image forming apparatus according to claim 5, wherein a nip pressure of the third pair of skew-feed rollers is set to be higher than a nip pressure of the first pair of skew-feed rollers.

* * * * *